US007624574B2

(12) United States Patent
Sawada et al.

(10) Patent No.: US 7,624,574 B2
(45) Date of Patent: Dec. 1, 2009

(54) PISTON APPARATUS, STIRLING ENGINE, EXTERNAL COMBUSTION ENGINE, AND FLUID DEVICE

(75) Inventors: Daisaku Sawada, Gotenba (JP); Hiroshi Yaguchi, Susono (JP); Shinichi Mitani, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 208 days.

(21) Appl. No.: 11/793,979

(22) PCT Filed: Dec. 27, 2005

(86) PCT No.: PCT/JP2005/023966

§ 371 (c)(1),
(2), (4) Date: Jun. 25, 2007

(87) PCT Pub. No.: WO2006/070832

PCT Pub. Date: Jul. 6, 2006

(65) Prior Publication Data

US 2008/0072751 A1 Mar. 27, 2008

(30) Foreign Application Priority Data

Dec. 27, 2004 (JP) ..... 2004-378172
Dec. 27, 2004 (JP) ..... 2004-378176

(51) Int. Cl.
*F01B 29/08* (2006.01)
*F15B 15/22* (2006.01)
*F01B 31/10* (2006.01)

(52) U.S. Cl. ..... 60/516; 91/24; 91/25; 92/158; 92/159; 92/160; 92/181 R

(58) Field of Classification Search ..... 60/39.6–39.63, 60/516–527; 91/20–27; 92/158–160, 176, 92/181 R–183
See application file for complete search history.

(56) References Cited

U.S. PATENT DOCUMENTS 3,035,879 A * 5/1962 Hanny et al. ..... 92/112

(Continued)

FOREIGN PATENT DOCUMENTS

JP A 07-224807 8/1995

(Continued)

*Primary Examiner*—Thomas E Denion
*Assistant Examiner*—Christopher Jetton
(74) *Attorney, Agent, or Firm*—Oliff & Berridge, PLC

(57) ABSTRACT

A piston apparatus which configures an air bearing by introducing a compressed working media into an inside of a piston, and ejecting the working media from plural holes arranged on a circumferential portion of the piston into a clearance between the piston and the cylinder, which prevents a back-flow of the working media in the piston to a working space, and which readily secures reliability and longevity is provided. The piston apparatus is applied to an external combustion engine 10, and includes a piston main body 211, a pressure-accumulating chamber 212 that is formed inside the piston main body, an introduction portion 214 that serves to introduce the compressed working media into the pressure-accumulating chamber, holes 216 that are arranged on a circumferential portion 211*b* of the piston main body and runs from the pressure-accumulating chamber to the clearance between the piston main body and the cylinder 22 of the external combustion engine, wherein the introduction portion is arranged to be communicable in an introduction direction to the pressure-accumulating chamber of the working fluid and an opposite direction of the introduction direction, and a channel resistance in the opposite direction in the introduction portion is larger than in the introduction direction.

15 Claims, 26 Drawing Sheets

U.S. PATENT DOCUMENTS 4,455,974 A * 6/1984 Shapiro et al. ..... 123/47 R

FOREIGN PATENT DOCUMENTS

JP A 2000-046431 2/2000

JP A 2002-349347 12/2002

JP A 2004-020048 1/2004

* cited by examiner

PISTON APPARATUS, STIRLING ENGINE, EXTERNAL COMBUSTION ENGINE, AND FLUID DEVICE

TECHNICAL FIELD

The present invention relates to a piston apparatus, a stirling engine, and an external combustion engine.

BACKGROUND ART

In recent years, stirling engines which have an excellent theoretical thermal efficiency attract attention as means for recovering exhaust heat of factories or exhaust heat of internal combustion engines mounted on vehicles such as passenger cars, buses, and trucks.

One known technique is described in Japanese Patent Application Laid-Open No. 2000-46431 (Patent Document 1) which discloses a piston apparatus which is applicable to an external combustion engine such as a stirling engine. A piston of an external combustion engine disclosed in Patent Document 1 is such a type that is applicable to a stirling engine provided with a displacer driven by the function of a working medium which repeats compression and expansion within a working space according to reciprocating movements of a piston in a cylinder. The piston apparatus includes a compression chamber which is formed inside the piston to temporarily store the working medium compressed in the working space, an orifice through which the working medium in the compression chamber is ejected to a clearance between the piston and the cylinder, and a check valve which is arranged at an end of the orifice at the side of the compression chamber. The check valve is arranged so as to prevent a back-flowback-flow of the working medium from the compression chamber to the working space at a time the pressure of the working medium in the working space is decreased due to the movements of the piston.

Patent Document 1: Japanese Patent Application Laid-Open No. 2000-46431

DISCLOSURE OF INVENTION

Problem to be Solved by the Invention

However, when a working medium is compressed in a working space of an external combustion engine such as a stirling engine, introduced into a piston, and ejected to a clearance between the piston and a cylinder through plural holes formed in a circumferential portion (outer circumferential portion) of the piston, it is difficult to secure reliability and longevity of a thus-formed air bearing. Because a one-way valve (check valve) conventionally used in such a configuration has a mechanical, movable part and opens/closes according to the vertical movements of the piston. Sometimes the movements of the movable part of the check valve relative to the acceleration of the vertical movement of the piston are not stable, and the movable part does not stay at a predetermined position. Then, the check valve cannot exert an accurate function thereof. Thus, the check valve poses constraints on the design and structure.

An object of the present invention is to provide a piston apparatus, a stirling engine, and an external combustion engine that form an air bearing by introducing a working medium compressed inside a working space of the external combustion engine into an inside of a piston, and ejecting the compressed working medium to a clearance between the piston and a cylinder through plural holes provided in a circumferential portion of the piston, wherein a function of suppressing a back-flow of the working medium inside the piston into the working space is securely provided, and reliability and longevity are secured.

Another object of the present invention is to provide a piston engine which introduces a working medium from a working space into a pressure-accumulating chamber arranged inside the piston via a compressed-state maintaining unit, and which ejects the working medium from a circumferential portion of the piston, wherein an operation failure of the compressed-state maintaining unit can be suppressed even when rapid acceleration works on the compressed-state maintaining unit.

Means for Solving Problem

According to one aspect of the present invention, a piston apparatus applied to an external combustion engine, includes a piston main body, a pressure-accumulating chamber that is formed inside the piston main body, an introduction portion that serves to introduce a working medium compressed in a working space of the external combustion engine into the pressure-accumulating chamber, and a hole that is formed on a circumferential portion of the piston main body and that runs from the pressure-accumulating chamber through the piston main body to a cylinder of the external combustion engine, wherein the introduction portion is arranged so that the working medium can flow in an introduction direction toward the pressure-accumulating chamber and an opposite direction of the introduction direction, and the introduction portion has a channel resistance which is larger for the opposite direction than for the introduction direction.

According to another aspect of the present invention, in the piston apparatus, difference between the channel resistance for the introduction direction and the channel resistance for the opposite direction in the introduction portion may not be based on an channel opening/closing operation of a channel of the introduction portion which is caused by an operation of a movable part such as a valving element, but based on a shape of the introduction portion.

According to still another aspect of the present invention, the piston apparatus may further include a channel that serves to introduce the working fluid compressed in the working space to the pressure-accumulating chamber, and a channel opening/closing unit that is provided in the pressure-accumulating chamber and that opens/closes the channel according to an operation of a movable part such as a valving element, wherein the movable part is configured to operate at a time the piston apparatus is activated, and to stop operation in a normal operation range of the piston apparatus so as to close the channel.

According to still another aspect of the present invention, in the piston apparatus, pressure Pc necessary for making the movable part perform an opening operation is set so as to satisfy expressions:

$$Pc<P_{+P} \text{ and}$$

$$Pc>(P_{+P}-PF),$$

where $P_{+P}$ represents pressure amplitude at a side of a higher pressure relative to an average pressure of the working space, and PF represents a saturation value of accumulated pressure of the pressure-accumulating chamber caused by the introduction portion.

According to still another aspect of the present invention, in the piston apparatus, the channel opening/closing unit may be arranged so that a direction of movements of the movable part in operation substantially coincides with an axial direction of the piston main body, and a pressure Pc' necessary for making the movable part perform the opening operation is set so as to satisfy expressions:

$$(Pc'+PA)<P_{+P} \text{ and}$$

$$(Pc'+PA)>(P_{+P}-PF),$$

where PA represents an amount of rise of pressure necessary for making the movable part perform the opening operation with an application of an upward maximum acceleration on the movable part at a set number of rotations lower than a number of rotations in a normal operation range of the piston apparatus.

According to still another aspect of the present invention, in the piston apparatus, a chamber may be arranged on the channel between the channel opening/closing unit and the working space, the chamber communicate with the working space via an orifice, and the working medium passes through the chamber.

According to still another aspect of the present invention, in the piston apparatus, the piston main body may be arranged so as to reciprocate in the cylinder, the introduction portion may be an introduction channel, and the piston apparatus may further include a pressurized-state maintaining unit which operates in a direction perpendicular to the direction of movements of the piston main body so as to introduce the working medium from an introduction-portion opening of the introduction channel which opens toward the pressure-accumulating chamber to the pressure-accumulating chamber, and to prevent a back-flow of the working medium in the pressure-accumulating chamber to the cylinder.

According to still another aspect of the present invention, in the piston apparatus, the pressurized-state maintaining unit may be a reed valve configured with a plate-like elastic body and provided with an operating portion and a fixed portion, and the introduction-portion opening may be formed in a valve-forming portion which has a valve attachment portion which is a plane parallel to the direction of movements of the piston main body, the fixed portion of the reed valve is attached to the valve attachment portion, and the introduction-portion opening is opened/closed by the operating portion.

According to still another aspect of the present invention, in the piston apparatus, the fixed portion and the operating portion of the reed valve may be arranged on a straight line parallel to the direction of movements of the piston main body.

According to still another aspect of the present invention, in the piston apparatus, the fixed portion of the reed valve may be arranged at each of a top surface side and a hem side of the piston main body, and the reed valve may be fixed to the valve attachment portion at the top surface side and the hem side of the piston main body.

According to still another aspect of the present invention, in the piston apparatus, the fixed portion of the reed valve may be arranged at a hem side of the piston main body, and the reed valve may be fixed to the valve attachment portion at the hem side of the piston main body.

According to still another aspect of the present invention, in the piston apparatus, the fixed portion of the reed valve may be arranged at a top surface side and a hem side of the piston main body on a straight line crossing with the direction of movements of the piston main body, and the reed valve may be fixed to the valve attachment portion at the top surface side and the hem side of the piston main body.

According to still another aspect of the present invention, in the piston apparatus, the fixed portion of the reed valve may be arranged in a direction perpendicular to the direction of movements of the piston main body, and the reed valve may be fixed to the valve attachment portion in the direction perpendicular to the direction of movements of the piston main body.

According to still another aspect of the present invention, in the piston apparatus, the introduction channel, the introduction-portion opening, and the pressurized-state maintaining unit may be arranged at a central portion of the top surface portion of the piston main body.

According to still another aspect of the present invention, a stirling engine includes the piston apparatus according to one of the aspects of the present invention as described above, and the cylinder.

According to still another aspect of the present invention, an external combustion engine includes a piston apparatus, and a cylinder. The piston apparatus includes a piston main body, a pressure-accumulating chamber formed inside the piston main body, an introduction portion that is arranged in a first portion corresponding to a predetermined height position in a circumferential portion of the piston main body, and that serves to introduce a working medium compressed in a working space of the external combustion engine into the pressure-accumulating chamber, and a hole that is arranged in a second portion corresponding to a position lower than the predetermined height position in the circumferential portion of the piston main body, and that runs from the pressure-accumulating chamber to a clearance between the piston main body and the cylinder, and a size of the clearance between the first portion in the circumferential portion of the piston main body and the cylinder is configured to be larger when the piston apparatus is at a top dead center than when the piston apparatus is at a bottom dead center.

According to still another aspect of the present invention, in the external combustion engine, a size of a clearance between the second portion in the circumferential portion of the piston main body and the cylinder may be configured to be substantially the same when the piston apparatus is at the top dead center and when the piston apparatus is at the bottom dead center, and a size of the clearance between the first portion and the cylinder and a size of the clearance between the second portion and the cylinder in the circumferential portion of the piston main body may be configured to be substantially the same when the piston apparatus is at the bottom dead center.

According to still another aspect of the present invention, in the external combustion engine, a diameter of an inner circumferential wall portion of the cylinder to which the first portion of the circumferential portion of the piston main body faces when the piston apparatus is at the bottom dead center may be configured to be smaller than a diameter of the inner circumferential wall portion of the cylinder to which the first portion of the circumferential portion of the piston main body faces when the piston apparatus is at the top dead center.

According to still another aspect of the present invention, in the external combustion engine, the external combustion engine may be an α-type stirling engine, and the size of the clearance between the first portion in the circumferential portion of the piston main body and the cylinder may be configured to be larger when the piston apparatus is within a range of ±45° of the top dead center than when the piston apparatus is outside the range.

According to still another aspect of the present invention, in the external combustion engine, a top surface of the introduction portion may be formed in a flat shape so that the entire top surface is of approximately the same height.

According to still another aspect of the present invention, a piston engine includes a piston that performs reciprocating movements in a cylinder, a hollow portion formed inside the piston, an introduction channel that communicates a working space in the cylinder with the hollow portion, and introduces a working fluid in the working space into the hollow portion, a pressurized-state maintaining unit that operates in a direction perpendicular to a direction of movements of the piston, that introduces the working fluid from an introduction-portion opening of the introduction channel which opens toward an inside of the hollow portion, and that prevents a back-flow of the working fluid from the hollow portion to the cylinder, and plural air-feed holes that are arranged on a circumferential portion of the piston, and that eject the working fluid in the hollow portion to a space between the circumferential portion of the piston and the cylinder.

In the piston engine which introduces the working fluid from the working space in the cylinder to the hollow portion in the piston, and ejects the introduced working fluid to a space between the circumferential portion of the piston and the cylinder, the pressurized-state maintaining unit is provided so as to operate in a direction perpendicular to the direction of movements of the piston. Therefore, even when the acceleration attributable to the reciprocating movements of the piston is applied to the pressurized-state maintaining unit, the operation of the pressurized-state maintaining unit is not affected significantly. As a result, even when the acceleration applied on the pressurized-state maintaining unit is large, the pressurized-state maintaining unit is prevented from malfunctioning.

EFFECT OF THE INVENTION

According to the present invention, when the working medium compressed in the working space of the external combustion engine is introduced inside the piston, the introduced working medium is ejected through plural holes arranged on the circumferential portion of the piston to the clearance between the piston and the cylinder, so as to form an air bearing, the present invention can securely provide a function of suppressing the back-flow of the working medium from the inside of the piston to the working space. Further, the reliability and the longevity can be readily secured.

EXPLANATIONS OF LETTERS OR NUMERALS

Figure 1:
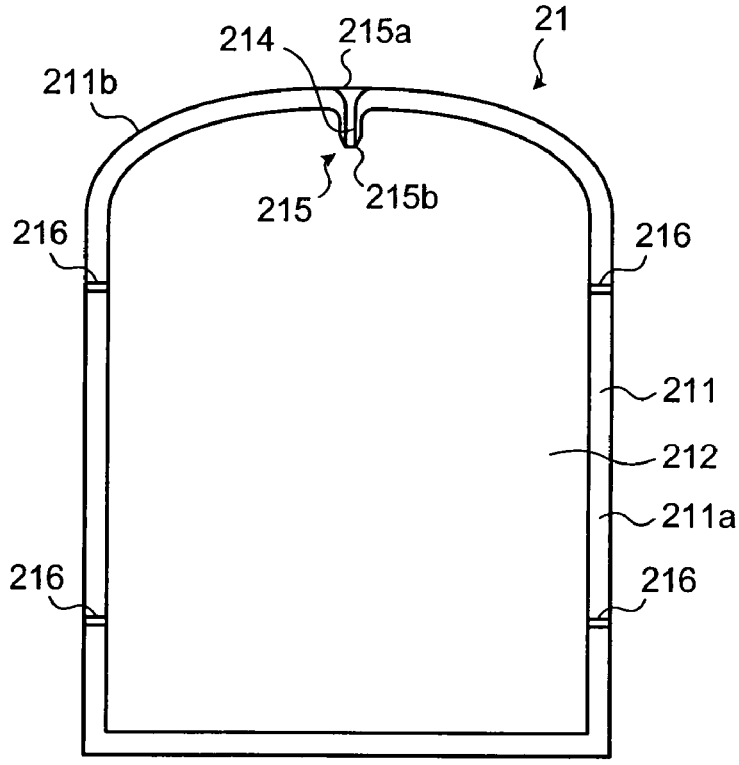
FIG. 1 is a vertical sectional view showing a piston apparatus according to a first embodiment of the present invention.

10 Stirling engine
20 High-temperature side power piston
21 Expansion piston
211 Piston main body
211*a* Circumferential portion
211*b* Top surface portion
212 Hollow portion (pressure-accumulating chamber)
214 Communication channel
215 Fluid device
216 Air-feed hole
22 High-temperature side cylinder
22*b* Top portion of high-temperature side cylinder
30 Low-temperature side power piston
31 Compression piston
32 Low-temperature side cylinder
45 Radiator
46 Regenerator
46*a* Top surface of regenerator
46*b* Bottom surface of regenerator
47 Heater
47*a* First end
47*b* Second end
48 Air bearing
50 Linear approximation mechanism
60 Piston pin
100 Exhaust pipe
720 High-temperature side piston/cylinder unit
721, 721*a*, 721*b*, 721*c* Piston
722 High-temperature side cylinder
730 Low-temperature side piston/cylinder unit
731 Piston
732 Low-temperature side cylinder
811 Piston main body
811*a* Circumferential portion
811*iw* Inner wall
811*s* Hem portion
811*b* Top surface portion
812 Pressure-accumulating chamber
813 Dividing member
814 Introduction channel
814*i* Inlet of working fluid
814*o* Outlet of working fluid
814*p* Opening surface
815, 815*a*, 815*b*, 815*c* Reed valve
816 Air-feed hole
816*o* Orifice
816*s* Enlarged portion
818 Valve-forming unit
818*p* Valve attachment unit
Pmax Maximum value of in-cylinder pressure
W In-cylinder pressure (composite waveform)

BEST MODE(S) FOR CARRYING OUT THE INVENTION

An exhaust heat recovery system to which a piston apparatus according to one embodiment of the present invention is applied will be described in detail below as a first embodiment with reference to the accompanying drawings. It should be noted that the present invention is not limited to the embodiments. Further, components of the embodiments described below may include those which can be readily achieved by those skilled in the art or those equivalent to those which can be readily achieved by those skilled in the art.

First Embodiment

An object of the first embodiment is to provide an exhaust heat recovery apparatus which includes a stirling engine having a piston apparatus. The piston apparatus configures an air bearing by introducing a working fluid compressed inside a working space of an α-type stirling engine into an inside of a piston, and ejecting the compressed working fluid to a clearance between the piston and a cylinder through plural holes provided in a circumferential portion of the piston, wherein a function of suppressing a back-flow of the working medium in the piston toward the working space can be securely obtained, and reliability and longevity are readily guaranteed.

When the stirling engine uses the exhaust heat of, for example, exhaust gas of an internal combustion engine of a vehicle as a heat source, there is a limitation in an obtainable heat amount. Therefore, it is necessary to operate the stirling engine as effectively as possible within the range of obtainable heat amount. Against such a background, the first embodiment aims at weight saving of the piston. Further, the first embodiment aims at downsizing of an apparatus dimension (overall configuration) of the stirling engine. This is because, when the stirling engine uses an exhaust heat of, for example, an exhaust gas of the internal combustion engine of a vehicle, as a heat source, the stirling engine sometimes needs to be installed in a limited space, such as a space adjacent to an exhaust pipe of an internal combustion engine arranged below a floor of the vehicle. A stirling engine described below realizes a reduced weight of a piston, and downsizing of an overall apparatus dimension.

Figure 3:
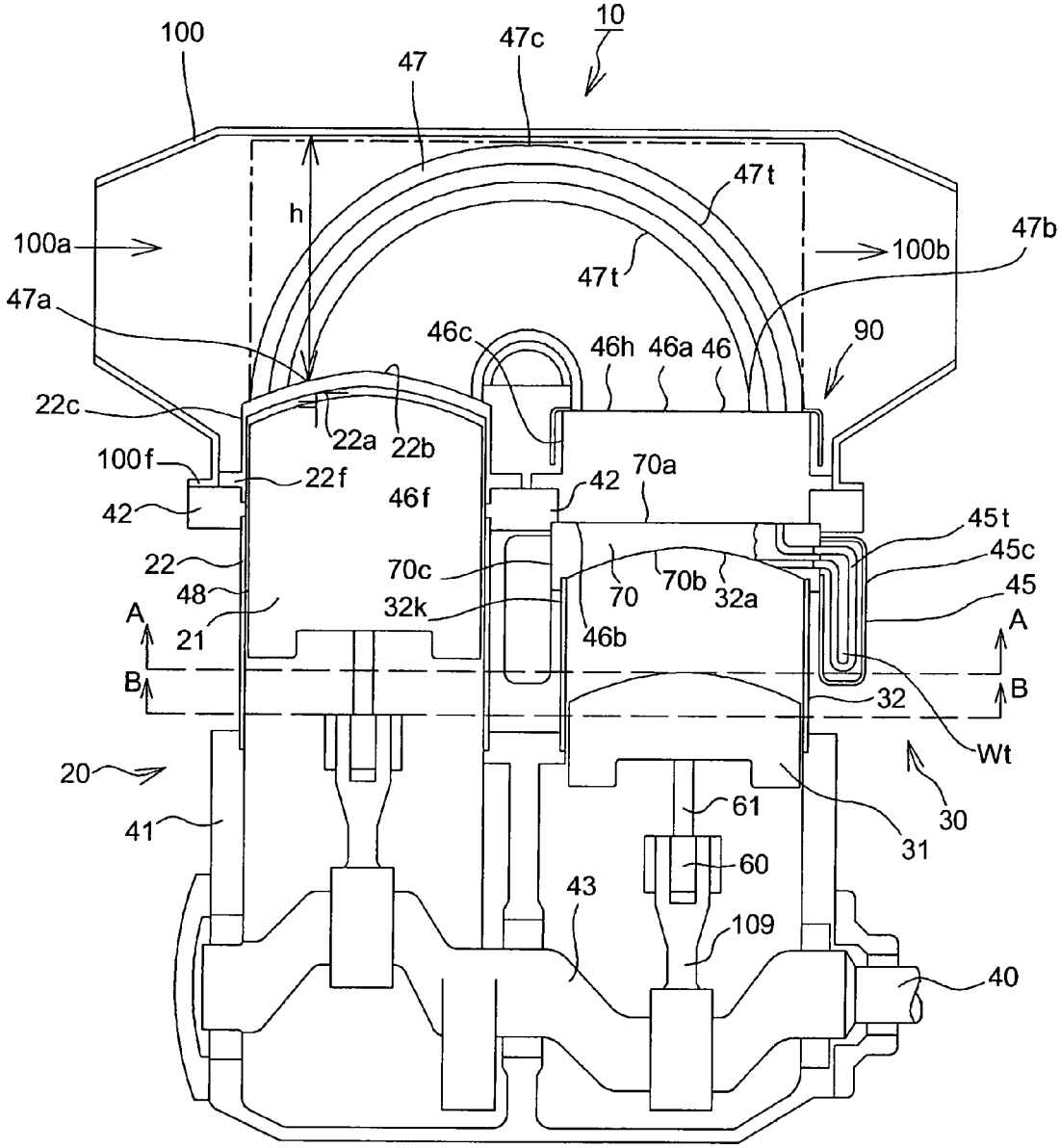
FIG. 3 is a front view showing a stirling engine according to the first embodiment of the present invention.
Figure 4:
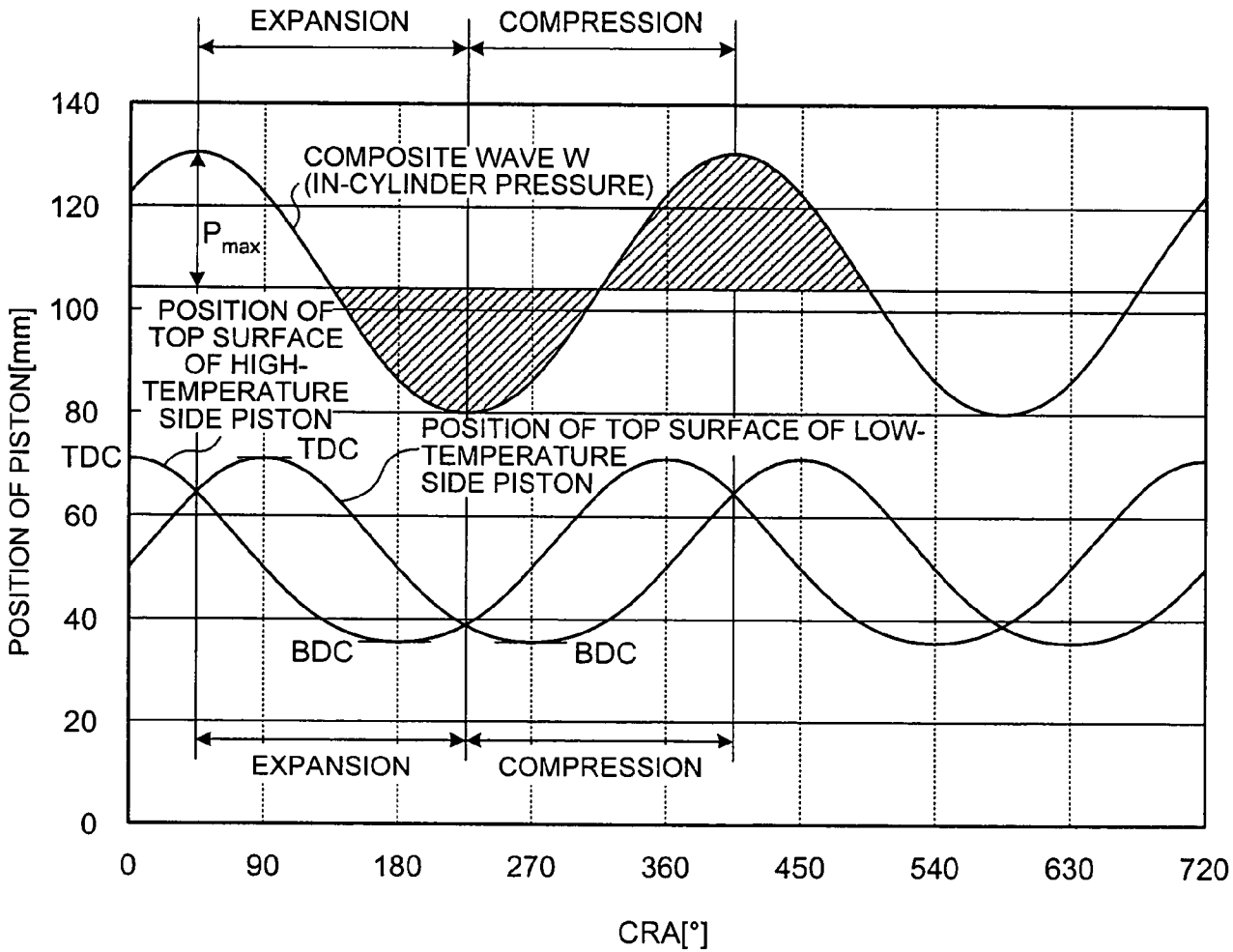
FIG. 4 is a graph for explaining an in-cylinder pressure of the stirling engine according to the first embodiment of the present invention.

FIG. 3 is a front view showing the stirling engine according to the first embodiment. As shown in FIG. 3, a stirling engine 10 according to the first embodiment is an α-type (two-piston-type) stirling engine, and is provided with two power pistons (piston/cylinder units) 20 and 30. Two power pistons 20 and 30 are arranged in parallel and connected in series. A phase difference is set so that a piston 31 of the low-temperature side power piston 30 moves approximately 90° later than a piston 21 of the high-temperature side power piston 20 in crank angle, as shown in FIG. 4.

A working fluid heated by a heater 47 flows into an upper space (expansion space) of a cylinder 22 of the high-temperature side power piston 20 (cylinder 22 will be referred to as high-temperature side cylinder, hereinbelow). A working fluid cooled by a radiator 45 flows into an upper space (compression space) of a cylinder 32 of the low-temperature side power piston 30 (cylinder 32 will be referred to as low-temperature side cylinder, hereinbelow).

A regenerator (regenerative heat exchanger) 46 accumulates heat when the working fluid moves back and forth between the expansion space and the compression space. Specifically, the regenerator 46 receives heat from the working fluid when the working fluid flows from the expansion space to the compression space, and delivers an accumulated heat to the working fluid when the working fluid flows from the compression space to the expansion space.

Along with the reciprocating movements of two pistons 21 and 31, reciprocating flows of the working gas occur, which changes the ratio of the working fluid in the expansion space of the high-temperature side cylinder 22 to the working fluid in the compression space of the low-temperature side cylinder 32, and at the same time the total volume of the working fluid changes, whereby the pressure variations occur. When two pistons 21 and 31 are at the same position, pressure varies as follows. Pressure is higher when the expansion piston 21 is at a lower position than at a higher position. On the other hand, pressure is lower when the compression piston 31 is at a lower position than at a higher position. Therefore, the expansion piston 21 performs a large positive work (expansion work) to the outside, and the compression piston 31 needs to receive work (compression work) from the outside. The expansion work is partially expended for the compression work and the rest is output through a drive shaft 40.

The drive shaft 40 is connected to a crank shaft 43 housed in a case 41. The crank shaft 43 is connected to two pistons 21 and 31 through a piston-side rod 61, a coupling pin 60, and a rod 109. The crank shaft 43 converts the reciprocating movements of two pistons 21 and 31 into rotating movements, and transmits the rotating movements to the drive shaft 40. A space inside the case 41 is pressurized by a pressurizing unit. This is for pressurizing the working fluid (i.e., air in the first embodiment) and extracting as much output as possible from the stirling engine 10.

The stirling engine 10 of the first embodiment is employed together with a gasoline engine (i.e., internal combustion engine) in a vehicle, thereby forming a hybrid system. The stirling engine 10 uses exhaust gas of the gasoline engine as a heat source. The heater 47 of the stirling engine 10 is arranged inside an exhaust pipe 100 of the gasoline engine of the vehicle. Heat energy recovered from the exhaust gas heats up the working fluid so as to run the stirling engine 10.

The stirling engine 10 of the first embodiment is installed in a limited space in the vehicle, specifically, the heater 47 thereof is housed inside the exhaust pipe 100. A degree of freedom in design can be increased when the apparatus as a whole is made compact. Therefore, in the stirling engine 10, two cylinders 22 and 32 are not arranged in a V-like shape. Two cylinders 22 and 32 are arranged in parallel and connected in series.

When the heater 47 is arranged inside the exhaust pipe 100, a high-temperature side cylinder 22 side of the heater 47 is arranged at an upstream side (i.e., a side close to the gasoline engine) 100*a* where a relatively high-temperature exhaust gas flows in the exhaust pipe 100, and a low-temperature side cylinder 32 side of the heater 47 is arranged at a downstream side (i.e., a side farther from the gasoline engine) 100*b* where a relatively low-temperature exhaust gas flows. This is for heating the high-temperature side cylinder 22 side of the heater 47 more than the other side.

Each of the high-temperature side cylinder 22 and the low-temperature side cylinder 32 is formed in a cylindrical shape and supported by a basal plate 42 which serves as a baseline. In the first embodiment, the basal plate 42 is placed at a reference position for each component of the stirling engine 10. Such a configuration guarantees a relative positional accuracy of each component of the stirling engine 10. Further, the basal plate 42 may serve as a reference when the stirling engine 10 is attached to the exhaust pipe (exhaust channel) 100 from which the exhaust heat is to be recovered.

The basal plate 42 is fixed to a flange 100*f* of the exhaust pipe 100 via a heat insulator (i.e., spacer not shown). Since the relative positional accuracy of the exhaust pipe 100 and the basal plate 42 is secured when they are fixed with each other, the basal plate 42 can be considered as a fixed structural object provided in the exhaust pipe 100 as an attachment surface. Further to the basal plate 42, a flange 22*f* is fixed. The flange 22*f* is arranged on a side surface (outer circumferential surface) of the high-temperature side cylinder 22. Still further to the basal plate 42, a flange 46*f* is fixed via a heat insulator (i.e., spacer not shown). The flange 46*f* is arranged on a side surface 46*c* (outer circumferential surface) of the regenerator 46. Still further, a dividing wall 70 mentioned later is fixed to the basal plate 42.

The basal plate 42 support all components of the stirling engine 10. Therefore, when the basal plate 42 is deformed due to the heat of the exhaust gas in the exhaust pipe 100, effect of the deformation extends over all the components of the stirling engine 10. Therefore, the heat insulator is arranged between the flange 100*f* of the exhaust pipe 100 and the basal plate 42, and additionally, a shroud 90 is arranged to minimize the transfer of the heat from the exhaust gas inside the exhaust pipe 100 to the basal plate 42.

The exhaust pipe 100 is attached to the stirling engine 10 via the basal plate 42. When the stirling engine 10 is attached to the basal plate 42, the basal plate 42 is made substantially parallel to an end surface, to which the heater 47 is connected, of the high-temperature side cylinder 22 (upper surface of the top portion 22*b*) and an end surface, to which the radiator 45 is connected, of the low-temperature side cylinder 32 (top surface 32*a*). Put differently, the stirling engine 10 is attached to the basal plate 42 so that the basal plate 42 is parallel to the rotation axis of the crank shaft 43 (or the drive shaft 40), or so that the central axis of the exhaust pipe 100 is parallel to the rotation axis of the crank shaft 43. Thus, the stirling engine 10 can be readily attached to the exhaust pipe 100 without major change in design of the existing exhaust pipe 100. Hence, the stirling engine 10 can be mounted on the exhaust pipe 100 without deterioration in performance, mountability, and noise-related functions of the internal combustion engine itself of the vehicle, from which the exhaust heat is recovered. Further, since the stirling engine 10 of the same specification can be mounted to different types of exhaust pipe only with the changes in the specification of the heater 47, the versatility of the stirling engine 10 can be increased.

The stirling engine 10 is arranged in a space adjacent to the exhaust pipe 100 arranged below the floor of the vehicle so that the stirling engine 10 lies horizontal, in other words, so that the axial direction of each of the high-temperature side cylinder 22 and the low-temperature side cylinder 32 is approximately parallel to the floor surface (not shown) of the vehicle, and two pistons 21 and 31 reciprocate in a horizontal direction. In the first embodiment, however, a top-dead-center side of two pistons 21 and 31 is described as an upper direction, and a bottom-dead-center side as a lower direction.

The working fluid with a higher average pressure can provide a higher output since the higher average pressure means a higher pressure difference at the same temperature difference caused by the radiator 45 and the heater 47. Hence, the working fluid in the high-temperature side cylinder 22 and the low-temperature side cylinder 32 is maintained in a high pressure.

The pistons (piston apparatuses) 21 and 31 are formed in a columnar shape. Between the outer circumferential surface of each of the pistons 21 and 31, and the inner circumferential surface of the corresponding cylinder 22 or 32, a minute clearance of a few tens micrometers (μm) is provided. The working fluid (which is a gaseous matter, and is air in the first embodiment) exists in the clearance thereby forming an air bearing 48. The air bearing 48 keeps the pistons 21 and 31 in a floating state relative to the cylinders 22 and 32 utilizing an air pressure (air distribution) generated in the minute clearance between the pistons 21 and 31 and the cylinders 22 and 32. The pistons 21 and 31 are supported by the air bearing 48 in a non-contact state with the cylinders 22 and 32. Therefore, no piston ring is arranged around the pistons 21 and 31, and lubricant oil, which is generally used together with the piston ring, is not employed. However, it is preferable that a solid lubricant member is arranged on the inner circumferential surface of each of the cylinder 22 and 32. This is because the solid lubricant member contributes to reduce the sliding resistance between the piston and the cylinder, for example, when the air bearing 48 does not work sufficiently at the time of start-up. As described above, the air bearing 48 maintains the air-tightness of the expansion space and the compression space with the use of the working fluid (gaseous matter), thereby providing a clearance seal in a ring-less, oil-less manner.

As shown in FIG. 1, the air bearing 48 is a hydrostatic air bearing which is configured by introducing the working fluid compressed in the working space of the stirling engine 10 inside the pistons 21 and 31 and ejecting the working fluid toward the clearance between the pistons 21 and 31 and the cylinders 22 and 32 through plural holes provided in the outer circumferential portions of the pistons 21 and 31. The hydrostatic air bearing is a unit which ejects a pressurized fluid to generate a static pressure, thereby making an object (e.g., pistons 21 and 31 in the first embodiment) float.

In the first embodiment, since the heat source of the stirling engine 10 is exhaust gas of the internal combustion engine of the vehicle, the obtainable heat amount is limited. Hence, it is necessary to operate the stirling engine 10 as effectively as possible within the limit of obtainable heat amount. Therefore, the top portion (upper portion) 22*b* of the high-temperature side cylinder 22 and the upper portion of the side surface 22*c* of the high-temperature side cylinder 22 are arranged inside the exhaust pipe 100 so that the working fluid flowing through the expansion space is as high in temperature as possible. Thus, the upper portion of the expansion piston 21 near the top dead center is placed inside the exhaust pipe 100, whereby the upper portion of the expansion piston 21 is heated effectively. In the stirling engine 10 of the first embodiment, the basal plate 42 is arranged to the high-temperature side cylinder 22 and the low-temperature side cylinder 32 at the side from which the working fluid is introduced, and the two cylinders 22 and 32 are fixed to the basal plate 42. In such a configuration, the high-temperature side cylinder 22 and the low-temperature side cylinder 32 are put under restraint, so that the increase in the distance between the high-temperature side cylinder 22 and the low-temperature side cylinder 32 is suppressed. As a result, even when the heater 47 is heated up during the operation of the stirling engine 10, the clearance between the cylinder and the piston is maintained and the air bearing 48 can be made to function properly.

Configurations of the pistons 21 and 31 will be described in detail below with reference to FIGS. 1 and 2.

FIG. 1 is a front view showing the piston 21 showing the configuration thereof. FIG. 2 is a vertical sectional view showing a main portion of the piston 21. As shown in FIG. 3, the pistons 21 and 31 are different in size but the same in configuration. FIGS. 1 and 2 show the configuration common to both the pistons 21 and 31. Hereinbelow, FIGS. 1 and 2 will be referred to as illustrating the configuration of the piston 21 (description of the piston 31 which has the same configuration will not be provided).

As shown in FIG. 1, the piston 21 includes a piston main body 211 and a hollow portion (pressure-accumulating chamber) 212 formed inside the piston main body 211. The piston main body 211 is formed in a shape of a cylinder whose upper portion and bottom portion are closed.

The piston main body 211 has a circumferential portion (sliding portion) 211*a* which slides against the high-temperature side cylinder 22 (FIG. 3), and a top-surface portion 211*b* which is formed in a lid-like shape integrally (i.e., continuously) with the circumferential portion 211*a*. In the top-surface portion 211*b*, a communication channel 214 is formed so as to communicate the working space inside the high-temperature side cylinder 22 with the hollow portion 212.

The communication channel 214 is configured with a fluid device 215 which has a significantly higher channel resistance to an adverse current than to a following current, and which does not have a movable part such as a valving element. Specifically, the fluid device 215 is shaped so as to have a relatively low channel resistance when the working fluid passing through the communication channel 214 is directed downward (direction from the working space to the hollow portion 212) (i.e., at the time the working fluid forms a following current). On the contrary, the fluid device 215 is shaped so as to have a significantly higher channel resistance when the working fluid is directed upward (direction from the hollow portion 212 to the working space) (i.e., at the time the working fluid forms an adverse current) in comparison with the time of the following current.

When the movements of the piston 21 causes the pressure of the working fluid in the working space of the high-temperature side cylinder 22 to decrease, the fluid device 215 suppresses the back-flow of the working fluid in the hollow portion 212 toward the working space in the high-temperature side cylinder 22. Since the fluid device 215 does not have a movable part like a valving element of the check valve (i.e., one-way valve), it is easy to secure the reliability and longevity, and further it does not pose much constraint on the design and the structure.

Figure 2:
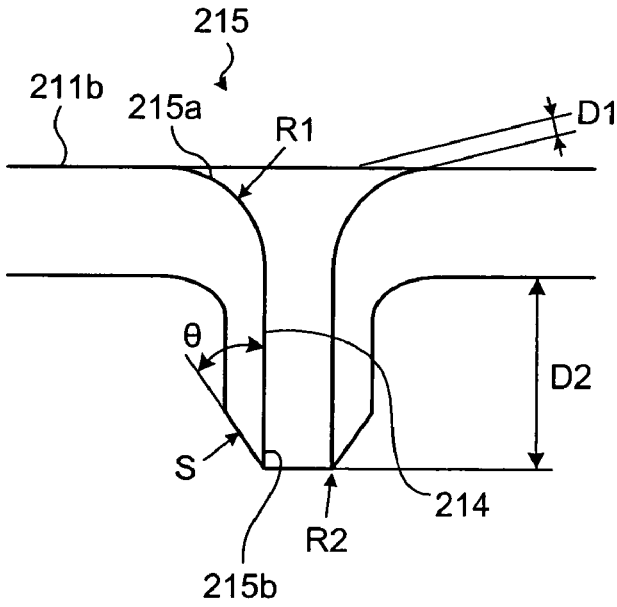
FIG. 2 is a vertical sectional view showing a main portion of the piston apparatus according to the first embodiment of the present invention.

FIG. 2 is an enlarged view showing the fluid device 215. In the fluid device 215, curvature R1 of a following-current inlet portion 215*a* is relatively large, whereas curvature R2 of an adverse-current inlet portion 215*b* is zero or extremely small. The following-current inlet portion 215*a* is formed so that the diameter dimension of an opening thereof is gradually decreased from outside to inside, so that the working fluid introduced into the communication channel 214 draws a smooth streamline. The adverse-current inlet portion 215*b* has a sharp edge which separates the working fluid in the hollow portion 212 moving like an adverse current toward the working space, thereby suppressing the amount of flow flowing back from the hollow portion 212 to the working space according to the effect of contracted flow, for example.

In the fluid device 215, while there is no protruding portion that protrudes from a top surface portion 211*b* towards the side of the working space on the side of the following-current inlet portion 215*a* (as indicated by reference character D1), there is a protruding portion D2 that protrudes towards the side of the hollow portion 212 at the side of the adverse-current inlet portion 215*b*, and an adverse current inlet portion 215*b* is formed at a tip end of the protruding portion D2.

Figure 6:
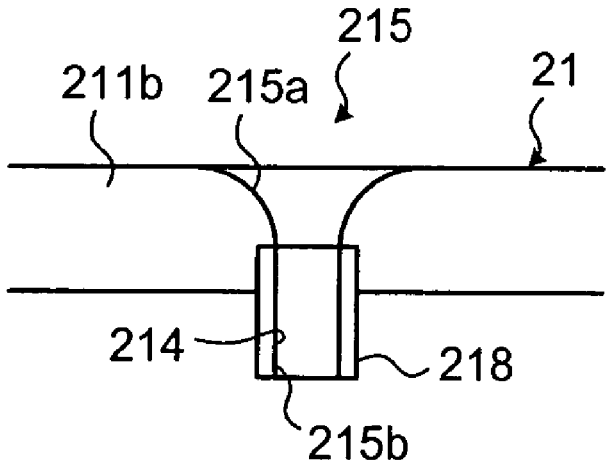
FIG. 6 is a vertical sectional view showing a main portion of another example of the piston apparatus according to the first embodiment of the present invention.
Figure 7:
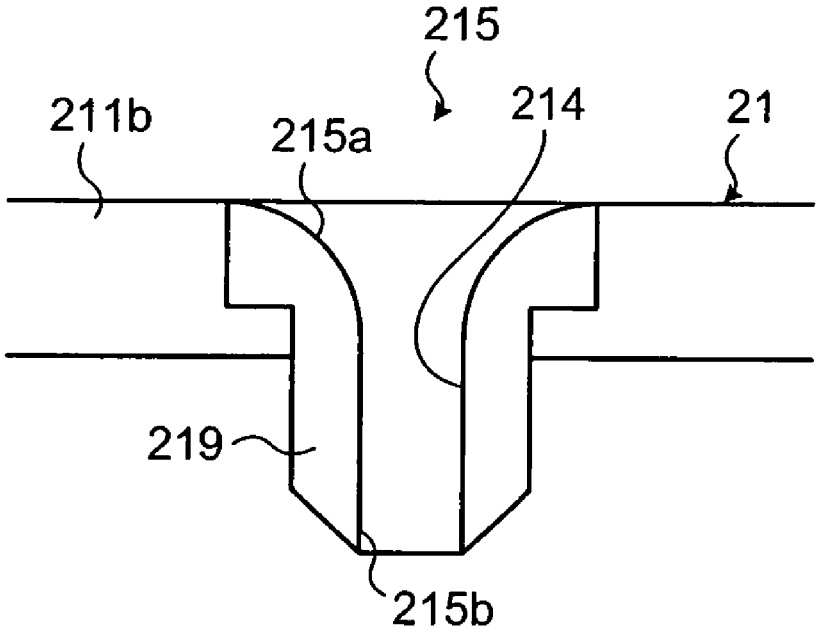
FIG. 7 is a vertical sectional view showing still another example of the piston apparatus according to the first embodiment of the present invention.

In the fluid device 215, an angle θ formed by an end surface S at the side of the adverse-current inlet portion 215*b* and the communication channel 214 is a sharp angle (i.e., smaller than 90°). However, when the protruding portion D2 of the adverse-current inlet portion 215*b* is thin and the end surface itself is extremely small, it is not necessary to define the angle (described later with reference to FIG. 6). The fluid device 215 forming the communication channel 214 shown in FIGS. 1 and 2 may be formed integrally (continuously) with the piston 21 (as one unit) as shown in FIG. 8, or may be separate from the piston 21 as shown in FIGS. 6 and 7.

Figure 8:
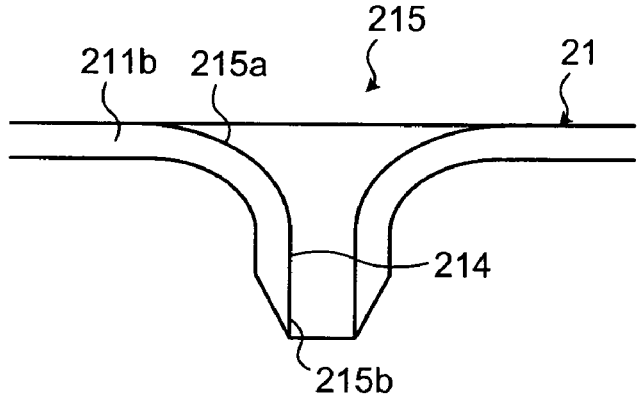
FIG. 8 is a vertical sectional view showing still further example of the piston apparatus according to the first embodiment of the present invention.

When the fluid device 215 is to be formed as one integral unit with the piston 21 as shown in FIG. 8, it is possible to form the fluid device 215 by punching out a portion corresponding to the top surface portion 211*b* of the piston, and causing plastic deformation. When the fluid device 215 is to be formed as a separate unit from the piston 21, it is possible to form the following-current inlet portion 215*a* integrally with the piston 21 and to configure the protruding portion (i.e., adverse-current inlet portion 215*b*) with a tube 218 which is separate from the piston 21, as shown in FIG. 6. Further, an entire portion corresponding to the fluid device 215 may be configured with a chip 219 as shown in FIG. 7.

As shown in FIG. 1, plural air-feed holes 216 are formed at regular intervals in a circumferential direction of the circumferential portion 211*a*. Along with the rise of the piston 21, the working fluid in the working space of the high-temperature side cylinder 22 is compressed. When the pressure of the working fluid exceeds the pressure of the hollow portion 212, a portion of the working fluid in the working space goes into the hollow portion 212 from the following-current inlet portion 215*a* through the communication channel 214. When the working fluid is introduced into the hollow portion 212 through the communication channel 214, a portion of the working fluid in the hollow portion 212 is ejected to the clearance between the piston 21 and the cylinder 22.

The communication channel 214 is formed at a central portion of the top surface portion 211*b*. Therefore, the distances between the communication channel 214 and the plural air-feed holes 216 are made equal. Therefore, ejected state (amount of ejection, ejection pressure, etc.) of the working fluid ejected from each of the plural air-feed holes 216 after the introduction of the working fluid in the working space into the hollow portion 212 through the communication channel 214 tends to be the same, and there is less possibility of a circumferential deviation in the working fluid ejected to the clearance. Thus, the air bearing 48 can function more stably.

It is desirable that the pressure of the working fluid sealed in the hollow portion 212 be slightly lower than the maximum compression pressure of the working fluid. FIG. 4 shows variations of the position of the top surface of the high-temperature side piston 21 and the position of the top surface of the low-temperature side piston 31. As described earlier, the phase difference is set so that the low-temperature side piston 31 moves 90° delayed in crank angle with respect to the high-temperature side piston 21.

In FIG. 4, a composite wave W of the waveform of the high-temperature side piston 21 and the waveform of the low-temperature side piston 31 shows an in-cylinder pressure. In FIG. 4, reference character Pmax indicates a maximum value (i.e, maximum compression pressure) of the in-cylinder pressure in a compression process. While the piston 21 operates, the piston main body 211 receives the maximum compression pressure Pmax at the maximum. When the working fluid whose pressure is slightly lower than the maximum compression pressure Pmax of the working fluid is sealed in the hollow portion 212, the piston main body 211 can possess a sufficient anti-pressure function (rigidity) with respect to the in-cylinder pressure while the in-cylinder pressure lower than the maximum compression pressure Pmax by a predetermined amount (i.e., pressure lower than the pressure of the hollow portion 212) is working on the piston main body 211 (i.e. except the time when the piston 21 is near the top dead center in the compression process). Therefore, the piston main body 211 (especially the portion where the air-feed hole 216 is not formed on the circumferential portion 211*a*) can be formed thin, without consideration of the resistance to pressure. Thus, the light weight can be realized.

When the working fluid whose pressure is slightly lower than the maximum compression pressure Pmax of the working fluid is sealed in the hollow portion 212, the piston operates as follows. While the piston 21 is at the position near the top dead center during the compression process, at one point, the pressure of the working space of the high-temperature side cylinder 22 comes to exceed the pressure of the hollow portion 212. Then, a portion of the working fluid in the working space is introduced through the communication channel 214, and a portion of the working fluid in the hollow portion 212 is ejected outside the piston 21 through the air-feed holes 216. When the piston 21 is placed at a position other than the position mentioned above, the pressure of the hollow portion 212 is higher than the pressure of the working space of the high-temperature side cylinder 22. However, since the fluid device 215 is configured in such a manner that the channel resistance is significantly higher at the time of adverse current in comparison with the time of following current, the back-flow of the working fluid in the hollow portion 212 into the working space in the high-temperature side cylinder 22 from the adverse-current inlet portion 215*b* through the communication channel 214 is suppressed.

At least one air-feed hole 216 is arranged in each of an upper portion and a lower portion of the piston 21 at an approximately equidistance from an approximately central portion of the piston 21 (for example, two for each of the upper and lower portions, and four in total are shown in FIG. 1). Such arrangement is effective to maintain the balance of the position of the piston 21 in the high-temperature side cylinder 22.

The heater 47 has plural heat transfer tubes (tube group) 47*t* which are arranged in an approximately U-like shape. A first end 47*a* of each heat transfer tube 47*t* is connected to an upper portion (end surface at the side of the top surface 22*a*) of the high-temperature side cylinder 22. First ends 47*a* of plural heat transfer tubes 47*t* are arranged approximately on the same plane (flat plane). First ends 47*a* of the plural heat transfer tubes 47*t* on approximately the same plane are each connected to the upper portion 22*b*, which is formed as an approximately flat surface, of the high-temperature side cylinder 22. Such shapes of the elements simplify the working and the connecting works of the first ends 47*a* sides of the plural heat transfer tubes 47*t*. On the other hand, a second end 47*b* of each heat transfer tube 47*t* is connected to an upper portion 46*a* (end surface at the side of the heater 47) of the regenerator 46.

The regenerator 46 is provided with a heat storage material (matrix not shown) and a regenerator housing 46*h* in which the heat storage material is stored. The regenerator housing 46*h* houses the heat storage material which is approximately columnar and whose section is approximately the same shape as that of the upper portion of the low-temperature side cylinder 32. The regenerator housing 46*h* is formed in a columnar shape (i.e., hollow columnar shape) whose bottom surface and upper surface are approximately the same shape as the section of the upper portion of the low-temperature side cylinder 32.

On a circumferential surface (outer circumferential surface) 46*c* of the regenerator 46, a flange 46*f* is arranged. The flange 46*f* is fixed to the basal plate 42 via the heat insulator. The regenerator 46 employs laminated wire sheets (laminated material) as the heat storage material. The wire sheets are laminated along a flow direction of the working fluid, and arranged in such a state that heat transfer seldom occurs between the plural metal sheets.

When the heat storage material receives heat from the working fluid flowing from the expansion space to the compression space, the uppermost wire sheet of the laminated plural wire sheets closest to the heater 47 first receives the heat of the working fluid and thereby lowers the temperature of the working fluid. Then the wire sheet second closest to the heater 47 receives the heat to further lower the temperature of the working fluid, and then, the wire sheet third closest to the heater 47 receives the heat to still further decrease the temperature, and thus, the temperature of the working fluid gradually decreases every time the working fluid passes through the wire sheet from the top to the bottom in the regenerator 46.

Due to the function mentioned earlier, the regenerator 46 is required to satisfy the following conditions. Firstly, the regenerator 46 has to have a high heat transfer capacity, a high heat storage capacity, a small flow resistance (flow loss, pressure loss), and a small heat conductivity in a direction of flow of the working fluid, so that a large temperature gradient can be set. Therefore, it is required that the heat transfer between the wire sheets is as low as possible. The wire sheet may be of stainless steel.

When the regenerator 46 is designed to be arranged inside the exhaust pipe 100, it is highly necessary to suppress the negative influence of the heat transfer of the regenerator housing 46*h* in the direction of flow of the working fluid. Hence, in the first embodiment, the regenerator housing 46*h* is provided with a shroud 90. The shroud 90 is intended to prevent the transfer of the heat inside the exhaust pipe 100 (approximately 600 to 800° C., for example) to the regenerator housing 46*h*. In particular, the shroud 90 is intended to prevent the transfer of heat to surfaces of the regenerator housing 46*h* other than the upper surface 46*a* (i.e., the side surfaces 46*c* and the flange 46*f*).

Here, the length of the expansion piston 21 in an axial direction is longer than that of the compression piston 31, and the length of the high-temperature side cylinder 22 in an axial direction is longer than that of the low-temperature side cylinder 32 due to the following reasons.

It is necessary to keep the space other than the expansion space in the high-temperature side power piston 20 and the space other than the compression space in the low-temperature side power piston 30, i.e., the space around the crank shaft 43 in each of the high-temperature side power piston 20 and the low-temperature side power piston 30 at a room temperature in order to suppress the efficiency degradation of the stirling engine 10. Hence, the high-temperature side cylinder 22 and the expansion piston 21, and the low-temperature side cylinder 32 and the compression piston 31 must be securely sealed (specifically, the air bearing 48 is used as the sealer as mentioned later) so that the high-temperature working fluid in the expansion space does not flow into the space around the crank shaft 43 at the side of the high-temperature side power piston 20, or the low-temperature working fluid in the compression space does not flow into the space around the crank shaft 43 at the side of the low-temperature side power piston 30.

On the other hand, since the top portion 22*b* and the upper portion of the side surface 22*c* of the high-temperature side cylinder 22 are housed inside the exhaust pipe 100 so that the expansion space attains a high temperature, the upper portion of the high-temperature side cylinder 22 and the upper portion of the expansion piston 21 undergo heat expansion. In a thermally-expanding portion of the upper portions of the high-temperature side cylinder 22 and the expansion piston 21, the sealing might not be securely performed. Hence, in the first embodiment, the length of the expansion piston 21 and the high-temperature side cylinder 22 in the axial direction are set long. Therefore, the temperature gradient of the expansion piston 21 is set larger in the axial direction, and the sealing is securely provided in a portion not influenced by the heat expansion (i.e., lower portion of the expansion piston 21). Further, since a space between the high-temperature side cylinder 22 and the expansion piston 21 is sealed at the lower portion of the expansion piston 21, the length of the high-temperature side cylinder 22 in the axial direction is set long so that sufficient length is secured as the travel distance of the sealed portion and the expansion space is sufficiently compressed.

The configuration of the radiator 45 will be described.

In FIG. 3, only a part of the plural heat transfer tubes 45*t* is shown, and other heat transfer tubes 45*t* are not shown.

The dividing wall (member) 70 is arranged between the regenerator 46 and the low-temperature side cylinder 32. The dividing wall 70 is formed of a material with low heat conductivity. The dividing wall 70 is designed so that the dimension thereof along an axial direction of the low-temperature side cylinder 32 is as short as possible while the size thereof is sufficiently large so as to lead the heat transfer tubes 45*t* around. This is to contribute to the downsizing of the stirling engine 10.

As mentioned above, the dividing wall 70 is fixed to the basal plate 42. The upper surface 70*a* of the dividing wall 70 is arranged so as to directly contact with the lower surface 46*b* (i.e., end surface opposite to the end surface 46*a* at the side of the heater 47) of the regenerator 46. The lower surface 70*b* of the dividing wall 70 serves as the top surface 32*a* of the low-temperature side cylinder 32. On the side surface 70*c* (i.e., outer circumferential surface) of the dividing wall 70, a radiator case 45*c* of the radiator 45 is fixed.

The radiator 45 is configured with a water-cooled shell-and-tube exchanger or a tubular exchanger. The radiator 45 includes plural heat transfer tubes (tube group) 45*t* and the radiator case 45*c*. Most part of the plural heat transfer tubes 45*t* of the radiator 45 is housed in the radiator case 45*c*. The part of the plural heat transfer tubes 45*t* housed in the radiator case 45*c* is brought into contact with cooling water (refrigerant) supplied to the radiator case 45*c*, whereby the working fluid flowing through the heat transfer tube 45*t* is cooled.

As described above, the radiator case 45*c* is fixed to the outer circumferential surface 70*c* of the dividing wall 70. The radiator case 45*c* is arranged like a ring over the circumferential direction of the outer circumferential surface 70*c*. The radiator case 45*c* is formed in a ring-like shape so as to surround the upper portion (portion corresponding to the compression space) of an outer circumferential portion 32*k* of the low-temperature side cylinder 32 from the circumferential direction. Alternatively, the radiator case 45*c* may be arranged so as to surround a part of the outer circumferential portion 32*k* of the low-temperature side cylinder 32 in the circumferential direction.

A sealing mechanism of the piston and the cylinder and a mechanism of the piston/crank unit will be described.

Since the heat source of the stirling engine 10 is the exhaust gas of the internal combustion engine of the vehicle as described above, there is a limit in the obtainable heat amount, whereby the stirling engine 10 must be operated within the range of the obtainable heat amount. Therefore, in the first embodiment, an internal friction of the stirling engine 10 is reduced as much as possible. In the first embodiment, the piston ring is not employed so as to eliminate the frictional loss caused by the piston ring whose frictional loss occupies the largest part of the internal friction in the stirling engine. Instead, the air bearing 48 is provided between the cylinders 22 and 32 and the pistons 21 and 31, respectively.

Since the sliding resistance of the air bearing 48 is extremely small, the internal friction of the stirling engine 10 can be significantly reduced. Even when the air bearing 48 is employed, the air-tightness between the cylinders 22 and 32 and the pistons 21 and 31 is secured, whereby there is no inconvenience caused by the leakage of the high-pressure working fluid during the expansion/compression.

The air bearing 48 is a bearing which supports the pistons 21 and 31 in a floating state utilizing the air pressure (air distribution) generated in a minute clearance between each of the cylinder 22 and the piston 21 and the cylinder 32 and the piston 31. In the air bearing 48 of the first embodiment, the diametrical clearance between the cylinder 22 or 32 and the piston 21 or 31 is several tens micrometers (μm). A hydrostatic air bearing is employed to realize an air bearing that supports an object in a floating state. The hydrostatic air bearing is realized by ejecting a pressurized fluid to generate static pressure, and keeping an object (i.e., pistons 21 and 31 in the first embodiment) in a floating state by the static pressure.

Further, the use of the air bearing 48 eliminates the need of lubricating oil which is employed with the piston ring. Therefore, there is no inconvenience caused by the lubricating oil, such as the deterioration of the heat exchanger (i.e., regenerator 46, heater 47) of the stirling engine 10.

When the pistons 21 and 31 are made to reciprocate inside the cylinders 22 and 32, respectively, with the use of the air bearing 48, the accuracy of the linear motion must be below the size of the diametrical clearance of the air bearing 48. Further, since the loading capacity of the air bearing 48 is low, side force of the pistons 21 and 31 must be substantially zero. In other words, since the air bearing 48 has a low capacity to bear the force in a diameter direction (i.e., lateral direction, or thrust direction) of the cylinders 22 and 32, the accuracy of the linear motions of the pistons 21 and 31 relative to the axial direction of the cylinders 22 and 32 must be particularly high. In particular, the air bearing 48, which supports the object in a floating state with the use of air pressure in the minute clearance, as applied in the first embodiment, has a lower capacity to bear the force in the thrust direction even in comparison with an air bearing which shoots high-pressure air. Therefore, a higher accuracy of the linear motions of the pistons is required.

Due to the reasons described above, the first embodiment employs a grasshopper mechanism (linear approximation link) 50 in the piston/crank unit. The size of a required mechanism is smaller in the grasshopper mechanism 50 in comparison with that in the other linear approximation mechanism (such as Watt mechanism) for achieving the same accuracy of linear motions. Therefore, the use of the grasshopper mechanism 50 makes the overall size of the apparatus more compact. In particular, since the stirling engine 10 of the first embodiment is installed in a limited space, for example, since the heater 47 thereof is housed inside the exhaust pipe of the passenger car, the compactness of the apparatus increases the degree of freedom in design. Further, since the grasshopper mechanism 50 can achieve the same accuracy of linear motions as other mechanism with a mechanism whose weight is lighter than that required in other mechanism, whereby the grasshopper mechanism 50 is advantageous in terms of energy efficiency. Still further, the grasshopper mechanism 50 is relatively simple in terms of its mechanical configuration, and therefore is easy to configure (manufacture, or assemble).

Figure 5:
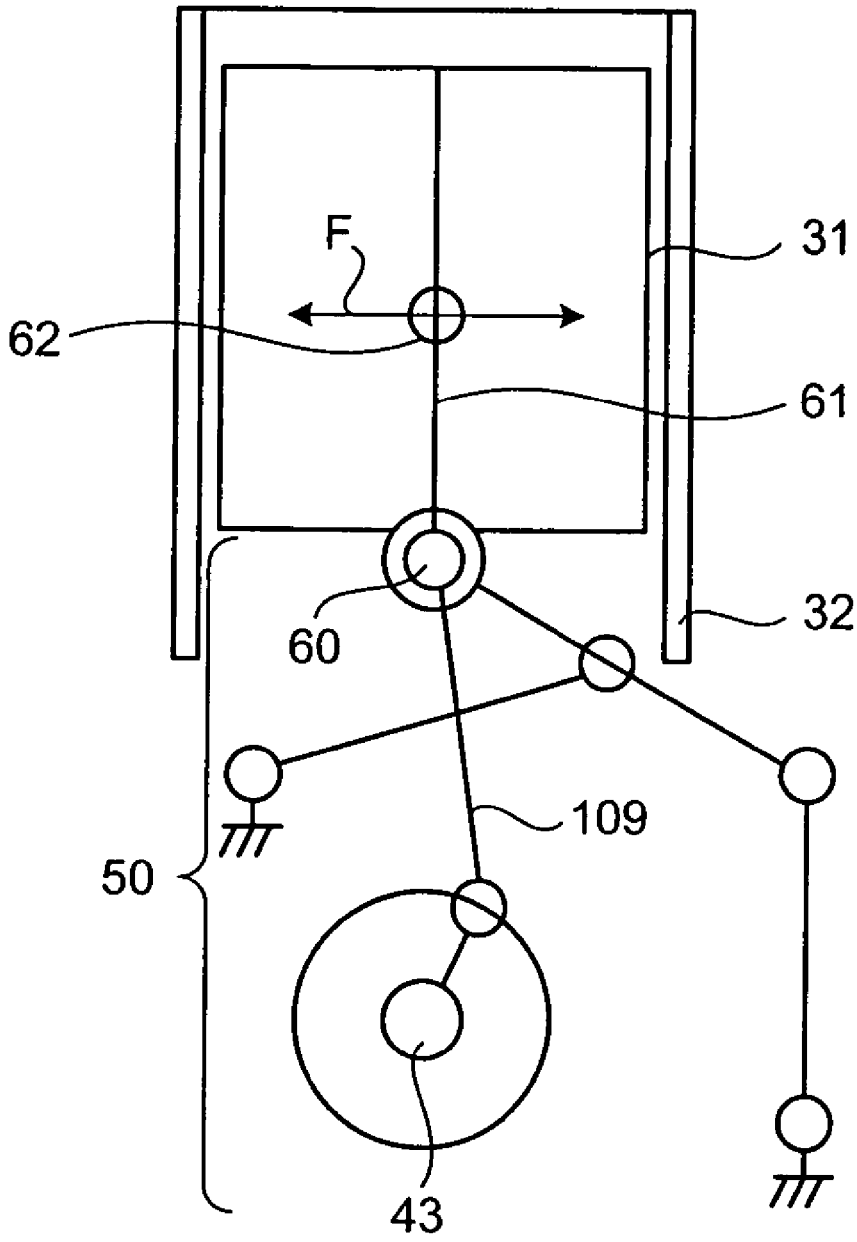
FIG. 5 is a diagram for explaining a linear approximation mechanism applied in the stirling engine according to the first embodiment of the present invention.

FIG. 5 is a diagram showing a schematic configuration of a piston/crank mechanism of the stirling engine 10. In the first embodiment, the piston/crank mechanism has a common structure in each of the high-temperature side power piston 20 side and the low-temperature side power piston 30 side. Therefore, only the structure at the side of the low-temperature side power piston 30 will be described below, and the structure at the side of the high-temperature side power piston 20 will not be provided.

As shown in FIGS. 5 and 3, the reciprocating movements of the compression piston 31 is transferred to the crank shaft 43 via a piston pin 62, the piston-side rod 61, the coupling pin 60, and the connecting rod 109, and are converted into rotating movements. The connecting rod 109 is supported by the grasshopper mechanism (linear approximation mechanism) 50 shown in FIG. 5, and causes the low-temperature side cylinder 32 to linearly reciprocate. Thus, when the grasshopper mechanism 50 supports the connecting rod 109, the side force F of the compression piston 31 becomes substantially zero. Hence, the air bearing 48 with low loading capacity can sufficiently supports the compression piston 31.

In the first embodiment described above, the stirling engine 10 is configured to be attached to the exhaust pipe 100 so as to use the exhaust gas of the internal combustion engine of the vehicle as a heat source. However, the stirling engine of the present invention is not limited to the type attached to the exhaust pipe of the internal combustion engine of the vehicle.

In the above, the example of the piston apparatus applied to the piston of the stirling engine is described with respect to the configuration, operation, and effect thereof. However, the piston apparatus can be readily applied to an external combustion engine other than the piston of the stirling engine, and similarly useful in other application.

First Modification of First Embodiment

A first modification of the first embodiment will be described with reference to FIGS. 9 to 11.

Figure 9:
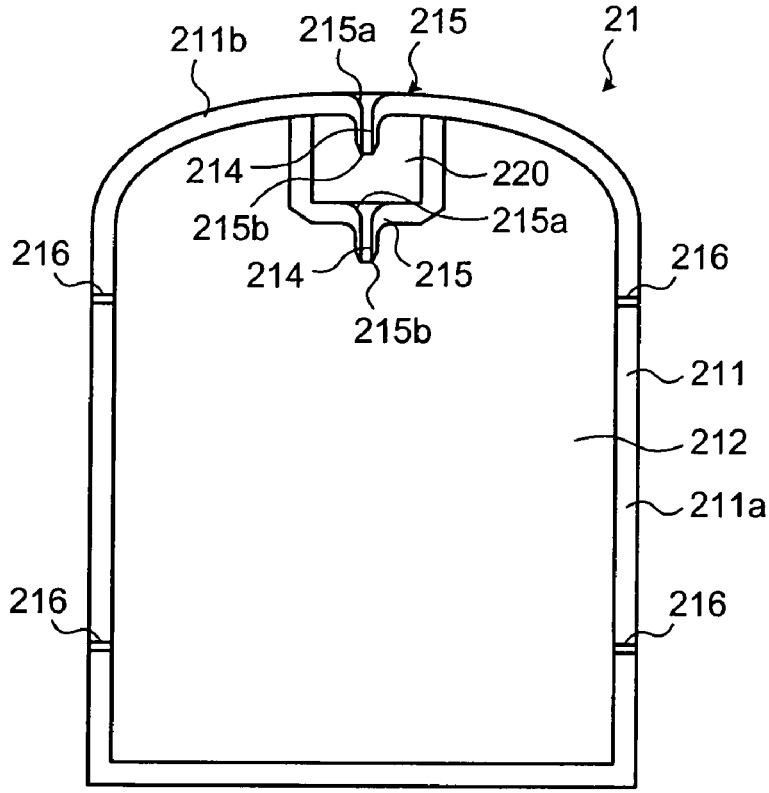
FIG. 9 is a vertical sectional view showing a first modification of the piston apparatus according to the first embodiment of the present invention.

As shown in FIG. 9, the fluid device 215 may have a two-stage configuration (multi-stage configuration) including a small chamber (buffer) 220. When configured in two stages, the fluid device 215 can take in a higher pressure into the hollow portion 212 in comparison with the pressure taken in by the one-stage device of the first embodiment. This is because, when the fluid device 215 is configured in plural stages, the channel resistance is even smaller at the time of adverse current than at the time of following current, and therefore the back-flow of the working fluid in the hollow portion 212 into the working space in the high-temperature side cylinder 22 from the adverse-current inlet portion 215*b* through the communication channel 214 is further prevented.

Figure 10:
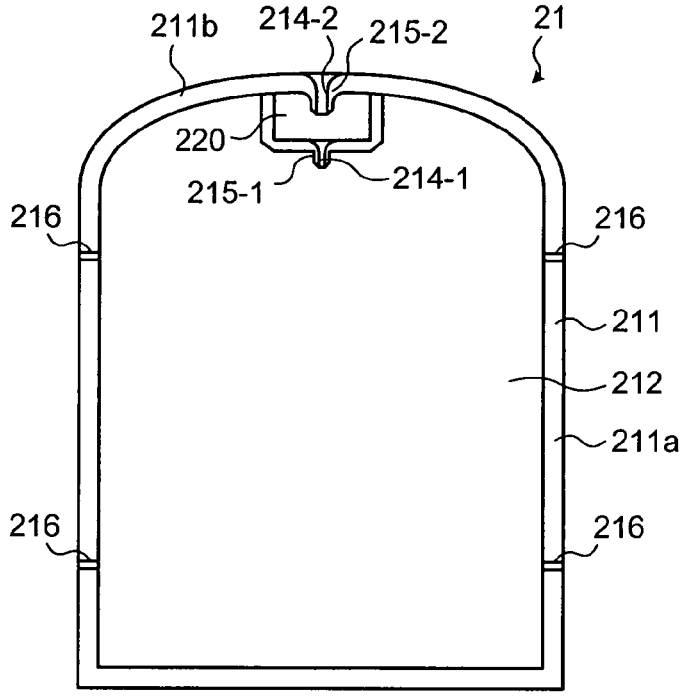
FIG. 10 is a vertical sectional view showing another example of the first modification of the piston apparatus according to the first embodiment of the present invention.
Figure 11:
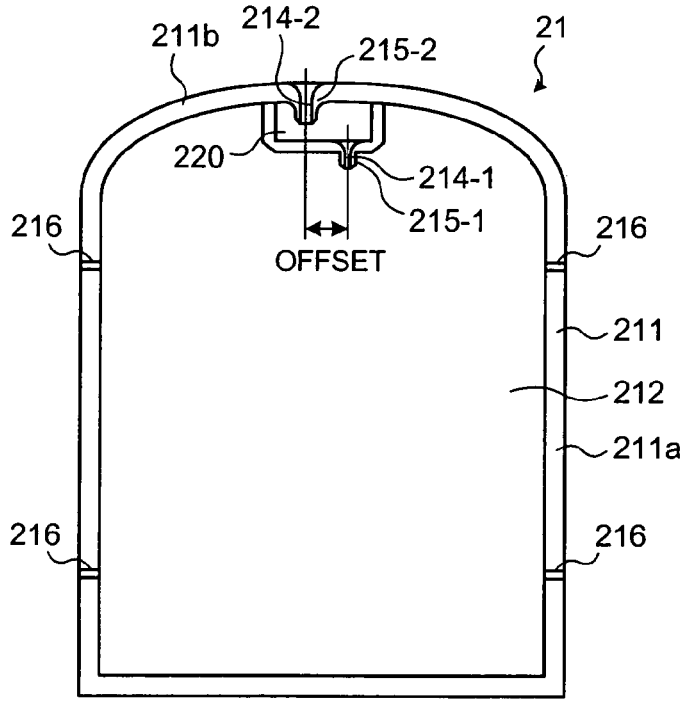
FIG. 11 is a vertical sectional view showing still another example of the first modification of the piston apparatus according to the first embodiment of the present invention.

As shown in FIG. 10, when the fluid device 215 is configured in two stages with the small chamber 220 arranged therebetween, it is preferable that a communication channel 214-1 of a fluid device 215-1 at the side of the hollow portion 212 be relatively small, whereas a communication channel 214-2 of a fluid device 215-2 at the side of the working space be relatively large. Further, for the enhancement of the function of the two-stage configuration, it is effective to arrange the two fluid devices 215-1 and 215-2 so that the streamlines of the communication channels 214-1 and 214-2 are offset with each other. When the streamlines of the communication channels 214-1 and 214-2 of the two fluid devices 215-1 and 215-2 are off from each other, the effect of the back-flow suppression can be enhanced.

Second Modification of First Embodiment

Figure 12:
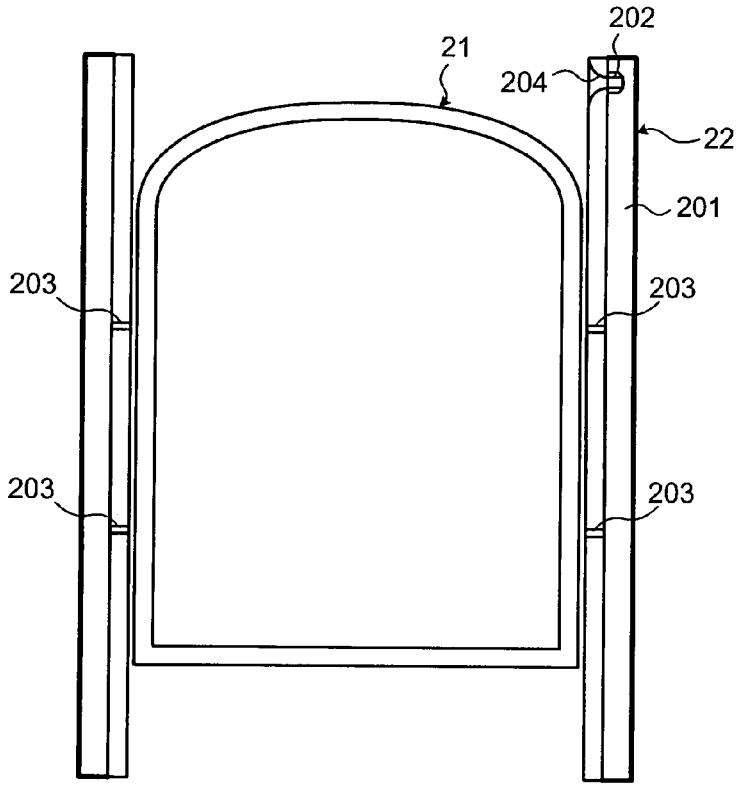
FIG. 12 is a vertical sectional view showing a main portion of a second modification of the piston apparatus according to the first embodiment of the present invention.

A second modification of the first embodiment will be described with reference to FIG. 12.

In the second modification, the hydrostatic floating mechanism may be arranged at the side of the high-temperature side cylinder 22. In FIG. 12, reference character 201 denotes a pressure-accumulating chamber provided in the high-temperature side cylinder 22, reference character 202 denotes a communication channel, and reference character 203 denotes a static-pressure supply hole for floating (air-feed hole).

The communication channel 202 is arranged at a higher point than the top dead center of the piston 21 and communicates the working space of the high-temperature side cylinder 22 with the pressure-accumulating chamber 201. The communication channel 202 is configured with a fluid device 204 which has a significantly higher channel resistance for an adverse current than for a following current and which has no movable part. Specifically, the fluid device 204 is configured in such a shape that the channel resistance is relatively small when the direction of flow of the working fluid passing through the communication channel 202 is that of the following current (i.e., directed from the side of the working space to the pressure-accumulating chamber 201), whereas the channel resistance is significantly large when the direction of flow of the working fluid is that of the adverse current (i.e., directed from the pressure-accumulating chamber 201 to the side of the working space) in comparison with the time of the following current.

Plural air-feed holes 203 are provided at regular intervals in a circumferential direction in the high-temperature side cylinder 22. Along with the rise of the piston 21, the working fluid in the working space of the high-temperature side cylinder 22 is compressed and the pressure of the working fluid exceeds the pressure of the pressure-accumulating chamber 201. Then, a part of the working fluid in the working space is introduced into the pressure-accumulating chamber 201 from a following-current inlet portion of the fluid device 204 through the communication channel 202. As the working fluid is introduced into the pressure-accumulating chamber 201 through the communication channel 202, a part of the working fluid in the pressure-accumulating chamber 201 is ejected to the clearance between the piston 21 and the cylinder 22 through the air-feed hole 203. Further, the fluid device 204 suppresses the back-flow of the working fluid in the pressure-accumulating chamber 201 into the working space in the high-temperature side cylinder 22 when the pressure of the working fluid in the working space of the high-temperature side cylinder 22 decreases due to the movements of the piston 21.

Second Embodiment

A second embodiment will be described with reference to FIGS. 13 to 18.

In the following description of the second embodiment, the description of those components common to those of the first embodiment will not be repeated.

Figure 13:
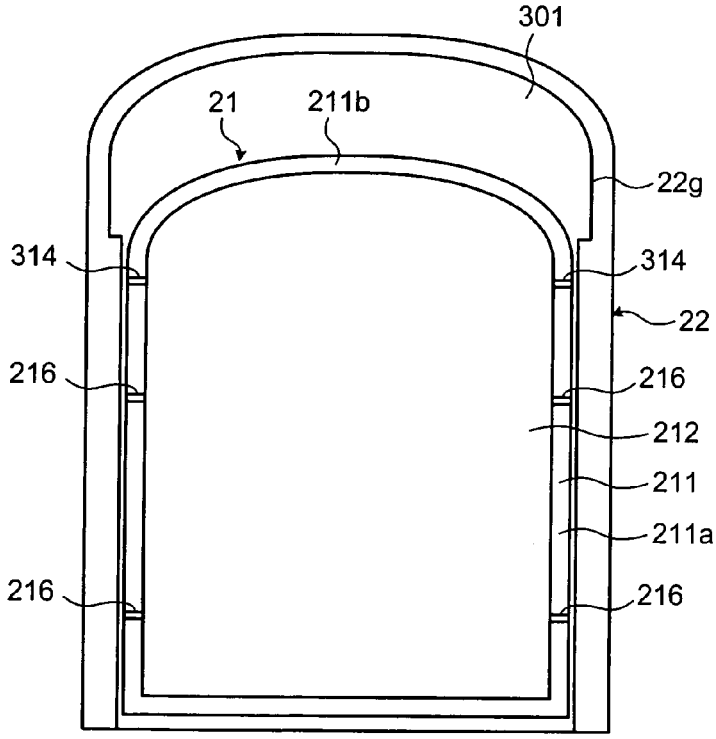
FIG. 13 is a vertical sectional view showing one operation state of the piston apparatus according to the second embodiment of the present invention.
Figure 14:
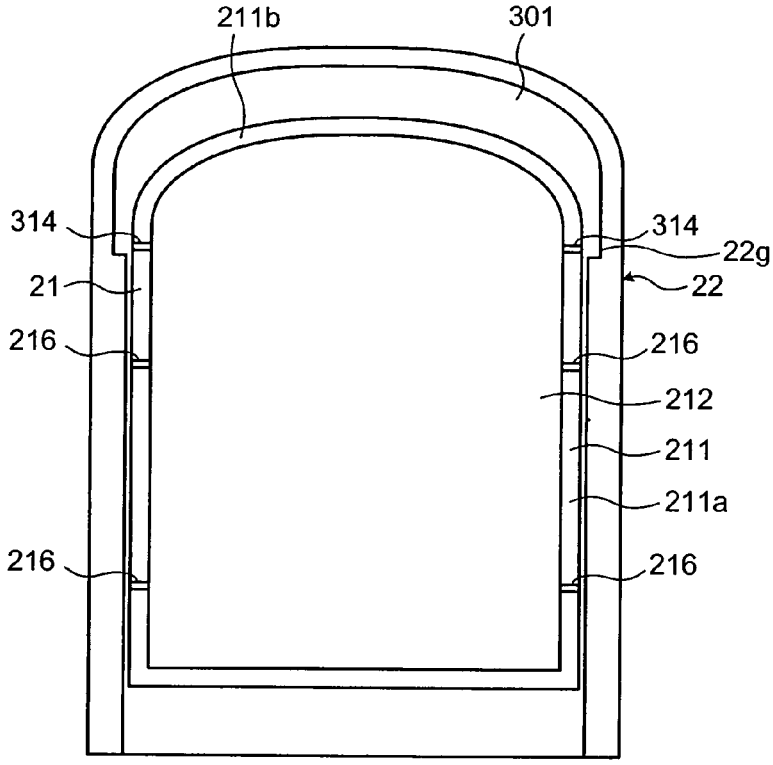
FIG. 14 is a vertical sectional view showing another operation state of the piston apparatus according to the second embodiment of the present invention.

In FIGS. 13 and 14, reference character 301 denotes the working space in the high-temperature side cylinder 22, reference character 22*g* denotes a diameter-expanded portion of the high-temperature side cylinder 22, and reference character 314 denotes a communication hole (communication channel) provided in the piston 21.

Similarly to the first embodiment, plural air-feed holes 216 are arranged at regular intervals in a circumferential direction in the circumferential portion (sliding portion) 211*a*, which slides against the high-temperature side cylinder 22, of the piston main body 211 of the piston 21. On the circumferential portion 211*a*, the communication channel 314 which communicates the working space 301 in the high-temperature side cylinder 22 with the hollow portion 212 is formed at a higher position than the position of the air-feed hole 216.

The communication channel 314 is arranged at such a position that the communication channel 314 communicates the hollow portion 212 with the working space 301 only when the piston 21 is near the top dead center (FIG. 14), and that the communication channel 314 is closed by a wall portion of the high-temperature side cylinder 22 at other time (FIG. 13). The communication channel 314 is a hole provided near the top surface portion 211*b* at an upper portion of the circumferential portion 211*a*, and faces against and is close to the inner circumferential wall portion of the high-temperature side cylinder 22.

A diameter-expanded portion 22*g* is arranged at an upper portion of the inner circumferential wall portion of the high-temperature side cylinder 22 (i.e., a portion forming the working space 301). The diameter-expanded portion 22*g* is a portion where the diameter is expanded in comparison with the other portion. The communication channel 314 is positioned at the height of the diameter-expanded portion 22*g* only when the piston 21 is near the top dead center, and communicates the hollow portion 212 with the working space 301 (FIG. 14), whereas the communication channel 314 is closed by the wall portion present at portion other than the diameter-expanded portion 22*g* of the high-temperature side cylinder 22 at other times (FIG. 13).

Specifically, in the state shown in FIG. 13, though the pressure of the working fluid in the working space 301 in the high-temperature side cylinder 22 decreases due to the movements of the piston 21, the clearance between the communication channel 314 and the inner circumferential wall portion of the high-temperature side cylinder 22 is as small as the clearance between the air-feed hole 216 and the inner circumferential wall portion of the high-temperature side cylinder 22, whereby the pressure inside the hollow portion 212 is hardly leaked outside.

As shown in FIG. 14, along with the rise of the piston 21, the working fluid in the working space 301 of the high-temperature side cylinder 22 is compressed, and the communication channel 314 arranged in the piston 21 reaches the height of the diameter-expanded portion 22*g*. Then, the clearance between the inner circumferential wall portion of the high-temperature side cylinder 22 and the piston 21 expands so as to be communicated with the working space 301. Then, a part of the working fluid in the working space 301 is introduced into the hollow portion 212 through the communication channel 314. Along with the introduction of the working fluid into the hollow portion 212 through the communication channel 314, a part of the working fluid in the hollow portion 212 is ejected to the clearance between the piston 21 and the cylinder 22 through the air-feed hole 216.

As described above, the communication channel 314 is arranged at a first portion corresponding to a predetermined height position in the circumferential portion 211*a* of the piston main body 211, and is used to introduce the working fluid compressed in the working space 301 into the pressure-accumulating chamber 212. The air-feed hole 216 is arranged at a second portion corresponding to a position lower than the predetermined height position in the circumferential portion 211*a* of the piston main body 211, and runs from the pressure-accumulating chamber 212 to the clearance between the piston main body 211 and the high-temperature side cylinder 22.

If the state of the apparatus when the piston 21 is at the top dead center and the state when the piston 21 is at the bottom dead center are compared, the clearance between the first portion of the circumferential portion 211*a* of the piston main body 211 and the high-temperature side cylinder 22 is configured to be larger when the piston 21 is at the top dead center than when the piston 21 is at the bottom dead center.

If the state of the apparatus when the piston 21 is at the top dead center and the state when the piston 21 is at the bottom dead center are compared, the clearance between the second portion of the circumferential portion 211*a* of the piston main body 211 and the high-temperature side cylinder 22 is configured to be approximately the same size in both states. When the first portion and the second portion of the circumferential portion 211*a* of the piston main body 211 are compared, the clearance with the high-temperature side cylinder 22 is configured to be approximately the same size when the piston 21 is at the bottom dead center.

The diameter of the inner circumferential wall portion 22*g* of the high-temperature side cylinder 22, to which the first portion of the circumferential portion 211*a* of the piston main body 211 faces when the piston 21 is at the top dead center, is configured to be larger than the diameter of the inner circumferential wall portion of the high-temperature side cylinder 22 to which the first portion of the circumferential portion 211*a* of the piston main body 211 faces when the piston 21 is at the bottom dead center.

As shown in FIG. 4, there is a phase difference of approximately 45° (crank angle) between the top dead center of each of the pistons 21 and 31 and the point of the maximum value (maximum compression pressure) Pmax of the in-cylinder pressure in the compression process, and the communication channel 314 is set to be in the open state (i.e., state shown in FIG. 14) within the range of 45° in the neighborhood of the top dead center (i.e., 45° from the top dead center in two directions, therefore, the range of 90°) of each of the piston 21 and 31, so as to secure the high pressure in the hollow portion 212, specifically to prevent the inflow/outflow of the working fluid between the hollow portion 212 and the working space 301 from lowering the efficiency.

As described above, the clearance between the first portion of the circumferential portion 211*a* of the piston main body 211 and the high-temperature side cylinder 22 is configured so as to be larger when the piston 21 is within the range of ±45° from the top dead center than when the piston 21 is outside this range.

Since the communication hole 314 in the second embodiment does not have the movable part such as a valving element as in the check valve (one-way valve), it is easy to secure the reliability and the longevity, and the element does not pose constraint on the design and configuration.

First Modification of Second Embodiment

Figure 15:
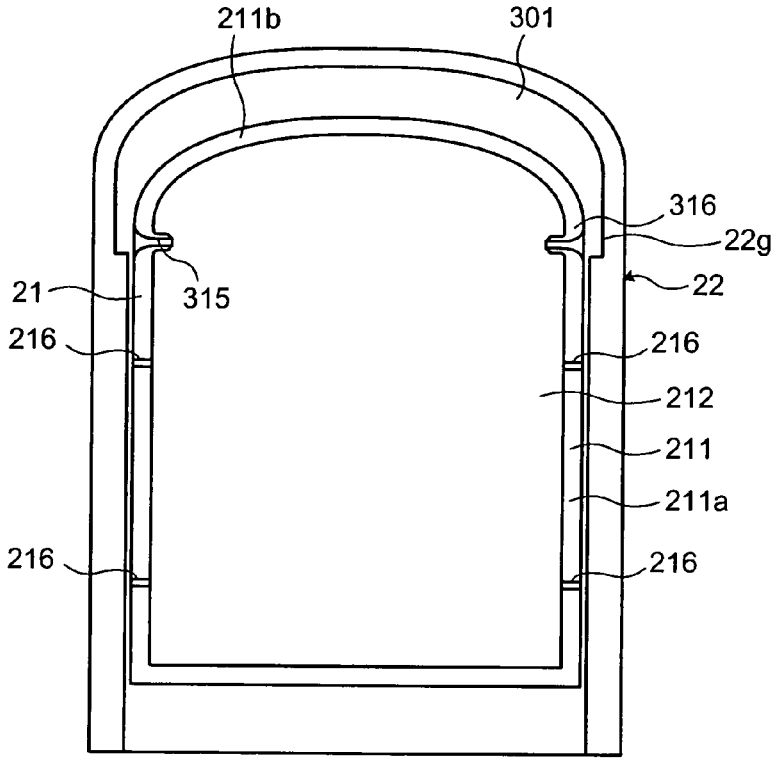
FIG. 15 is a vertical sectional view showing a first modification of the piston apparatus according to the second embodiment of the present invention.
Figure 16:
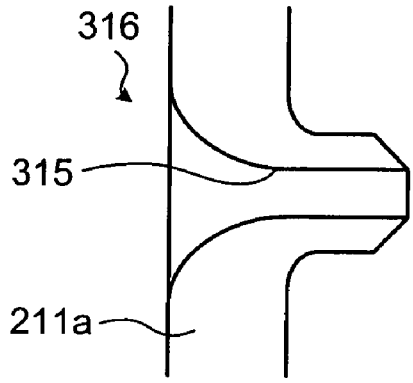
FIG. 16 is a vertical sectional view showing a main portion of the first modification of the piston apparatus according to the second embodiment of the present invention.

With reference to FIGS. 15 and 16, a first modification of the second embodiment will be described.

As shown in FIGS. 15 and 16, the communication channel 315 is configured with a fluid device 316 which has a significantly larger channel resistance for the adverse current than for the following current and which does not have a movable part, similarly to the first embodiment. Specifically, the fluid device 316 is configured in such a shape that the channel resistance is relatively small when the direction of the flow of the working fluid passing through the communication channel 315 is the direction of the following current, and that the channel resistance is significantly larger at the time of adverse current than at the time of following current.

According to the first modification, the effect of preventing the inflow/outflow of the working fluid between the hollow portion 212 and the working space 301 from deteriorating the efficiency is further enhanced.

Second Modification of Second Embodiment

A second modification of the second embodiment will be described with reference to FIGS. 17 and 18.

Figure 17:
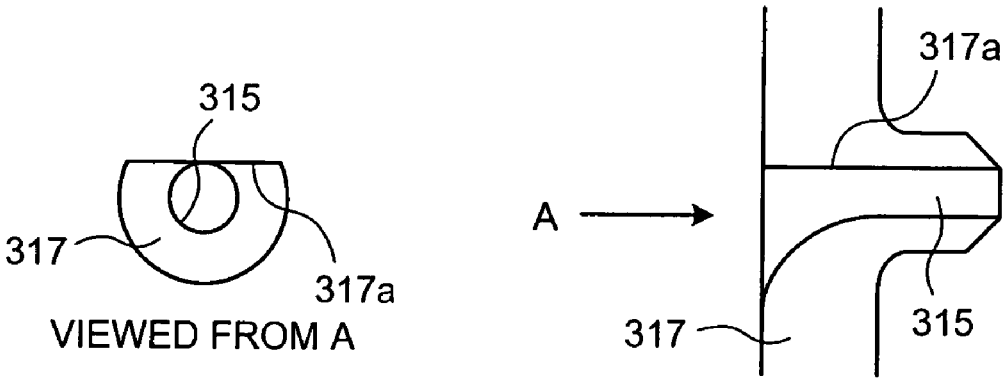
FIG. 17 is a diagram showing a main portion of a second modification of the piston apparatus according to the second embodiment of the present invention.
Figure 18:
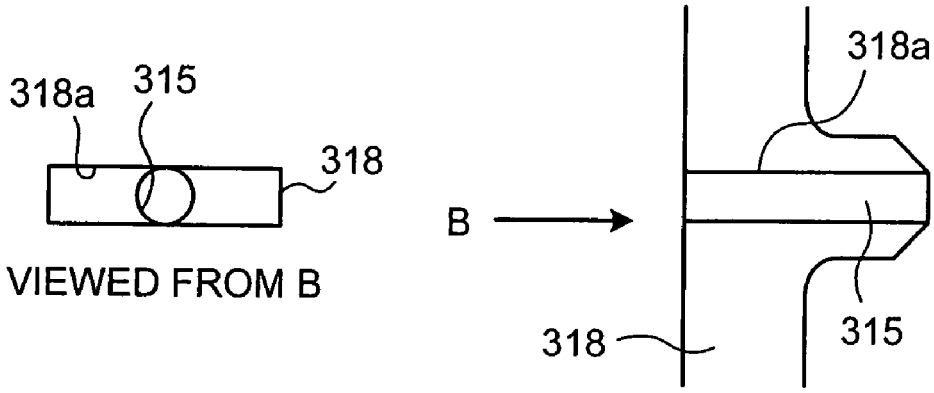
FIG. 18 is a diagram showing the main portion of the second modification of the piston apparatus according to the second embodiment of the present invention.

As shown in FIGS. 17 and 18, different from the fluid device 316 of the first modification, in the fluid devices 317 and 318 of the second modification, top surfaces 317*a* and 318*a* among surfaces forming the inlet for a portion of the working fluid of the working space 301 to flow into the hollow portion 212 through the communication channel 315 are formed as flat surfaces. Therefore, when the piston 21 rises, the top surfaces 317*a* and 318*a* of the inlets of the fluid devices 317 and 318 simultaneously reach the height of the diameter-expanded portion 22*g* entirely so as to communicate with the working space 310, whereby the accuracy of the period during which the communication channel 315 communicates with the working space 301 (i.e., open period) is enhanced.

Third Embodiment

A third embodiment will be described with reference to FIGS. 19 to 23.

In the following description of the third embodiment, the description of those components common to those of the above embodiments will not be repeated.

When the fluid device without an operating mechanism (i.e., movable part) is employed as in the first embodiment, though it is easy to secure reliability and longevity, the accumulated pressure value in the hollow portion increases only slowly at the time of activation and the air bearing cannot provide a sufficient force to float the piston 21 (FIG. 1) for an extended period of time. Therefore, a special hardening treatment must be provided to the surface of the piston/cylinder unit to secure wear-resistant characteristic. The reason why the rise of the accumulated pressure value in the hollow portion slows at the activation will be described.

As described earlier, when the fluid device whose channel resistance significantly varies depending on the direction of flow (i.e., depending on whether it is a following current or an adverse current) is employed, the apparatus must be designed so that the amount of introduced flow per unit time is small. The purpose of such a design is to decrease the movements (amount of inflow/outflow) between the working space and the pressure-accumulating space while keeping a high current speed. Therefore, a few ten cycles is required until the accumulated pressure value rises at the time of activation.

Figure 19:
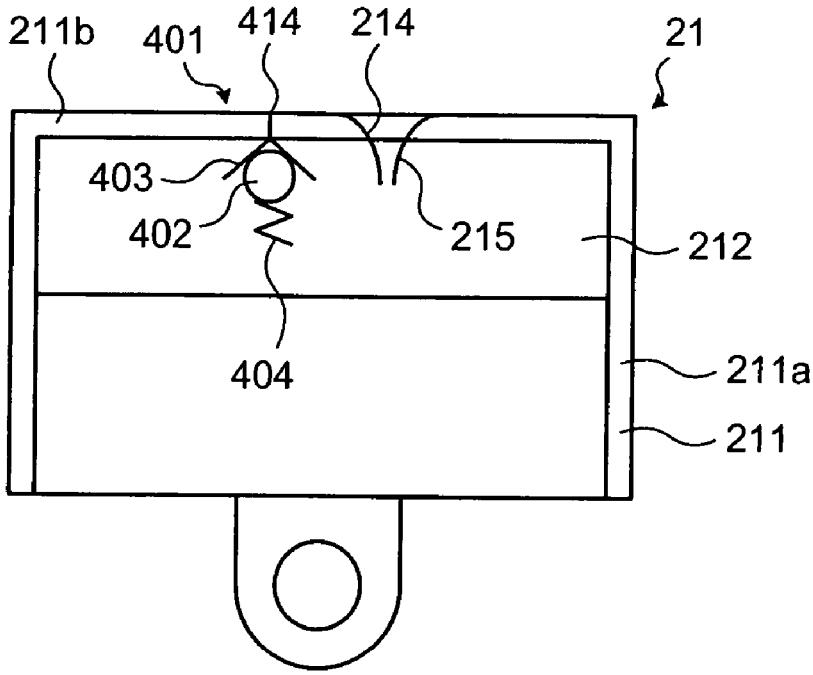
FIG. 19 is a vertical sectional view showing a piston apparatus according to a third embodiment of the present invention.

Hence, in the third embodiment, the fluid device 215 is employed together with a check valve 401 as a device to introduce pressure into the hollow portion (pressure-accumulating chamber) 212 of the piston 21 as shown in FIG. 19. A first and a second communication channels 214 and 414 are formed at the top surface portion 211*b* of the piston so as to communicate the working space of the high-temperature side cylinder 22 and the hollow portion 212. The first communication channel 214 is configured with the fluid device 215 which has a relatively small channel resistance at the following current, and a significantly large channel resistance at the adverse current in comparison with the following current. Further, the check valve 401 is provided in the hollow portion 212 at a position close to the second communication channel 414.

The check valve 401 has a valving element (movable part) 402, a valve seat 403, and a spring 404 which pushes the valving element 402 into the valve seat 403. The check valve 401 operates (opens) only at the time of activation. Once the normal operation starts (once the apparatus enters a normal operation range), the valving element 402 stops (closes) to stop the functioning of the check valve and to keep the second communication channel 414 closed.

Figure 20:
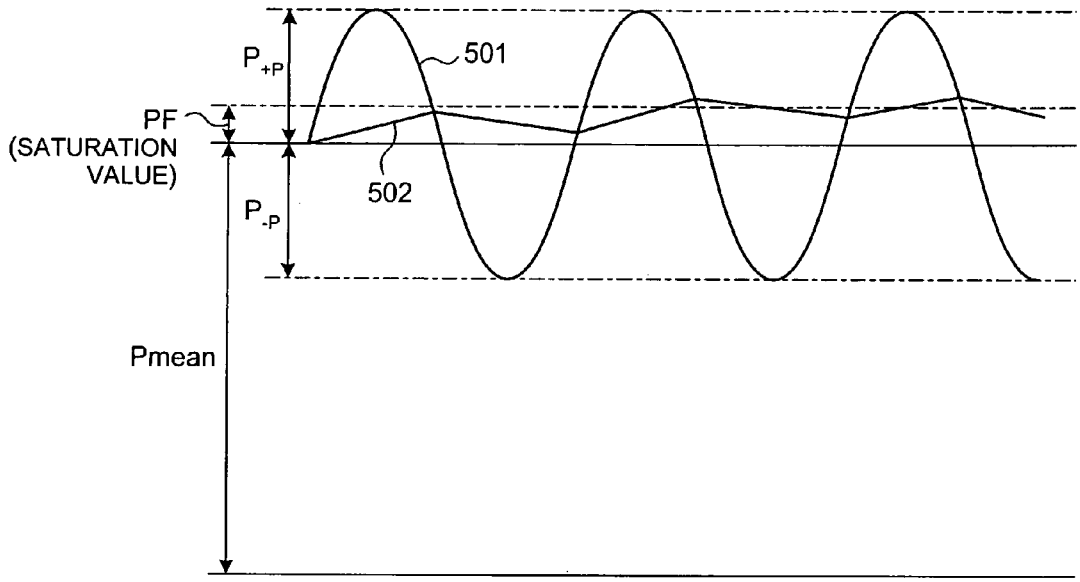
FIG. 20 is a graph of pressure in a working space and saturation value of accumulated pressure of a fluid device in the piston apparatus according to the third embodiment of the present invention.
Figure 21:
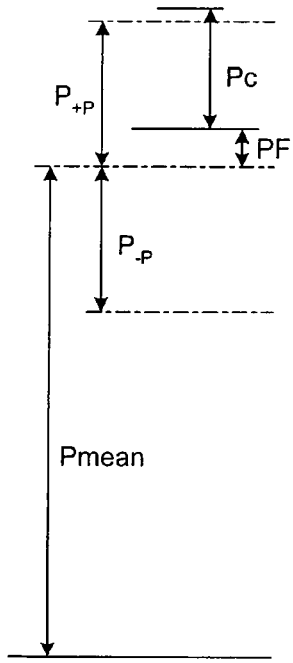
FIG. 21 is a diagram explaining a set value of a valve-opening pressure of a check valve in the piston apparatus according to the third embodiment of the present invention.

In FIG. 20, reference character 501 denotes the pressure in the working space of the high-temperature side cylinder 22, and reference character 502 denotes the variations in saturation value PF of accumulated pressure immediately after the activation. As shown in FIGS. 20 and 21, when the pressure amplitude on the positive side relative to the average value (average pressure) Pmean of the pressure 501 in the working space is represented as $P_{+P}$, and the saturation value of the accumulated pressure of the fluid device 215 is represented as PF, the check valve 401 can function as described above if the check valve 401 is designed so that a set value Pc of valve-opening pressure of the check valve 401 satisfies the following expressions:

$$Pc<P_{+P}, \text{ and}$$

$$Pc>(P_{+P}+PF), \text{ or } (Pc+PF)>P_{+P}.$$

When the PF is small, e.g., at the time of activation, $P_{+P}$ exceeds the set valve-opening pressure value Pc of the check valve 401, and the check valve 401 is open. Then, the pressure is introduced into the hollow portion 212 through the second communication channel 414. As the PF increases (as the accumulated pressure value of the hollow portion 212 increases after the activation), the check valve 401 is closed. Then, the valving element 402 of the check valve 401 is fixed to the valve seat 403 and stops the movements.

Figure 22:
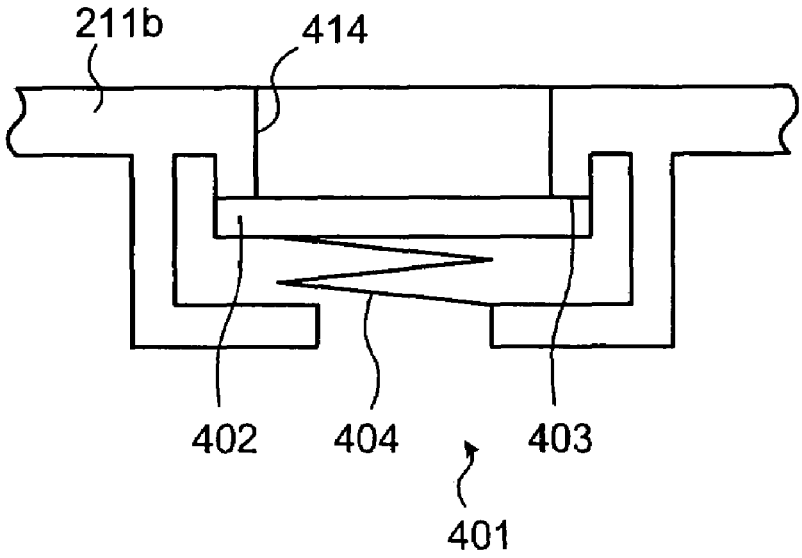
FIG. 22 is a vertical sectional view showing a main portion of a first modification of the piston apparatus according to the third embodiment of the present invention.
Figure 23:
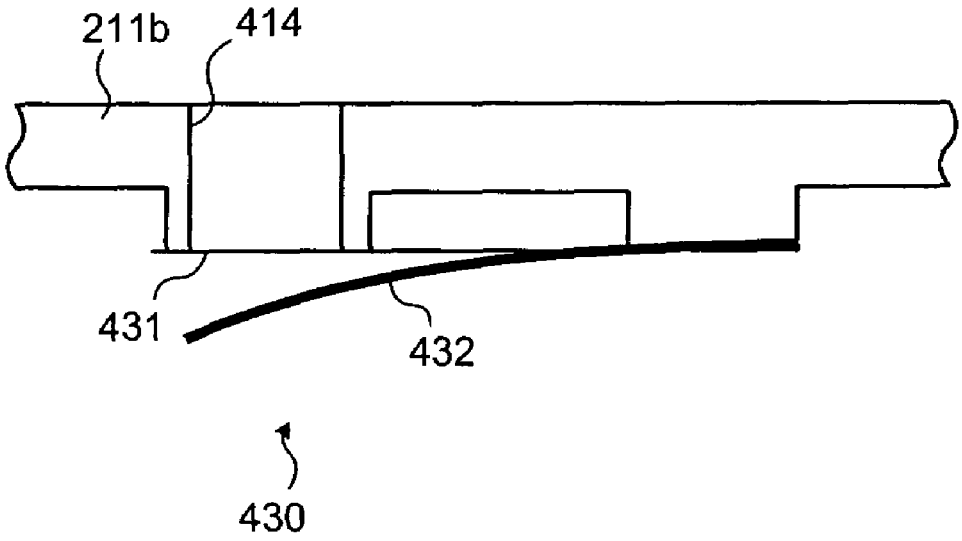
FIG. 23 is a vertical sectional view showing a main portion of another example of the first modification of the piston apparatus according to the third embodiment of the present invention.

As shown in FIG. 22, the set valve-opening pressure value Pc of the check valve 401 is designed based on the force of the spring 404 and the area of the valve seat. Further, if a reed valve 430 is employed, the above function can be achieved by giving a residual stress corresponding to the set valve-opening pressure value Pc to the reed 431 (in the seated state). In FIG. 23, reference character 432 denotes a valve guide.

According to the third embodiment, the accumulated pressure value of the hollow portion 212 can be increased via the check valves 401 and 430 relatively early at the time of activation (including immediately after the activation). After the accumulated pressure value of the hollow portion 212 is increased to a predetermined value at the time of activation, the movable part 402 of the check valve 401 and the movable part 431 of the check valve 430 remain in a stopped state (closed state). Therefore, the uncertain behavior, reliability, and durability would not pose significant problems, similarly to the first embodiment.

First Modification of Third Embodiment

A first modification of the third embodiment will be described with reference to FIGS. 22 to 24.

When the check valves 401 and 430 are arranged as shown in FIGS. 22 and 23 so that the moving direction of the movable parts 402 and 431 of the check valves 401 and 430 coincides with the vertical direction (direction of acceleration) of the piston 21, and the acceleration working on the movable parts 402 and 431 is taken into consideration, a piston apparatus with a still more favorable performance than the third embodiment can be obtained.

Figure 24:
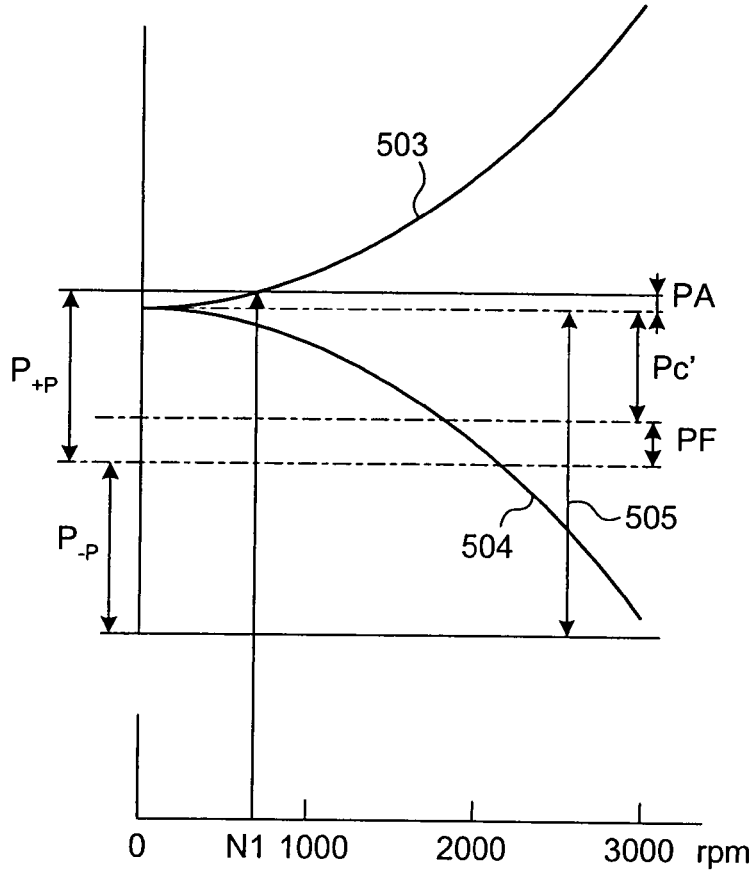
FIG. 24 is a diagram explaining a set value of a valve-opening pressure of a check valve in the first modification of the piston apparatus according to the third embodiment of the present invention.

In FIG. 24, reference character 503 denotes the amount of rise in the valve-opening pressure caused by the upward (direction to close the valve) maximum acceleration (applied when the piston 21 is at the top dead center) working on the movable parts 402 and 431 of the check valves 401 and 430. As shown in FIG. 24, the amount of rise in the valve-opening pressure 503 increases according to the number of rotations (rpm) of the stirling engine 10.

On the other hand, reference character 504 denotes the amount of rise in the valve-closing pressure caused by the downward (direction to open the valve) maximum acceleration (applied when the piston 21 is at the bottom dead center) working on the movable parts 402 and 431 of the check valves 401 and 430. As shown in FIG. 24, the amount of rise in the valve-closing pressure 504 increases according to the number of rotations of the stirling engine 10.

As shown in FIG. 24, when the amount of rise in the valve-opening pressure caused by the upward maximum acceleration working on the movable parts 402 and 431 of the check valves 401 and 430 when the number of rotations is N1 which is set to be lower than the normal operation range is represented as PA, valve-opening pressure Pc' of the movable parts 402 and 431 of the check valves 401 and 430 satisfies the following expressions:

$$Pc' \leqq (P_{+P} - PA), \text{ and}$$

$$Pc' + PA < (P_{+P} - PF), \text{ or } Pc' > (P_{+P} - PF - PA).$$

According to the first modification, the valve-opening pressure Pc' of the movable parts 402 and 431 of the check valves 401 and 430 can be designed to be smaller than the set valve-opening pressure value Pc of the third embodiment by the amount of PA (for example, the force of the spring 404 of the check valve 401 can be designed to be weaker), so that the check valves 401 and 430 are made to be easily open at the early phase of the activation, whereby the accumulated pressure value of the hollow portion 212 can be increased during cycles of a smaller number at the early phase of the activation.

In the first modification, as the amount of rise in the valve-opening pressure 503 caused by the upward maximum acceleration working on the movable parts 402 and 431 rises according to the rise in the number of rotations of the stirling engine 10, the check valves 401 and 430 become difficult to open. Utilizing this characteristic, the check valves 401 and 430 can be designed so as to make the valve-opening pressure Pc' of the movable parts 402 and 431 of the check valves 401 and 430 lower. Thus, when the number of rotations of the stirling engine 10 is small (at the early phase of the activation), the check valves 401 and 430 can be made to open easily, whereby the accumulated pressure value of the hollow portion 212 can be increased within cycles of a smaller number.

When the piston 21 is at the bottom dead center, the raised amount of the valve-closing pressure caused by the downward maximum acceleration works on the movable parts 402 and 431. At this time, since the working space of the high-temperature side cylinder 22 is at a lower pressure than the pressure within the pressure-accumulating chamber of the hollow portion 212, the check valves 401 and 430 are difficult to open even if the valve-opening pressure Pc' of the movable parts 402 and 431 of the check valves 401 and 430 is designed to be low. Even when the number of rotations of the stirling engine 10 increases and the amount of rise of the valve-closing pressure caused by the downward maximum acceleration working on the movable parts 402 and 431 increases, the check valves 401 and 430 do not open unless the amount of rise of the valve-closing pressure 504 exceeds ($Pc'+PF-P_{-P}$). In the example shown in FIG. 24, the amount of rise of the valve-closing pressure 504 does not exceed ($Pc'+PF-P_{-P}$) indicated by reference character 505 while the number of rotation is not more than 3000, and therefore the check valves 401 and 430 do not open in this period.

In view of the above, in the first modification, the amount of rise of the valve-closing pressure 504 is designed so as not to exceed ($Pc'+PF-P_{-P}$) 505 while the number of rotations is a predetermined number within an actual operation range. Alternatively, the mass of the movable parts 402 and 431 of the check valves 401 and 430 may be decreased so that the amount of rise of the valve-closing pressure 504, which increases corresponding to the number of rotations, draws a gentler slope, so that the amount of rise of the valve-closing pressure 504 does not exceed ($Pc'+PF-P_{-P}$) 505 within the actual operation range where the number of rotations is the predetermined number of rotations.

If it is desirable to securely suppress the opening of the check valves 401 and 430 when the piston 21 is at the bottom dead center by preventing the influence of the amount of rise of the valve-closing pressure 504 caused by the downward maximum acceleration on the movable parts 402 and 431 even when the mass of the movable parts 402 and 431 of the check valves 401 and 431 is large and the number of rotations increases, the moving direction of the movable parts of the check valves may be set so as not to coincide with the vertical (acceleration) direction of the piston 21, as shown in FIG. 22.

Second Modification of Third Embodiment

A second modification of the third embodiment will be described with reference to FIGS. 25 to 28.

Figure 25:
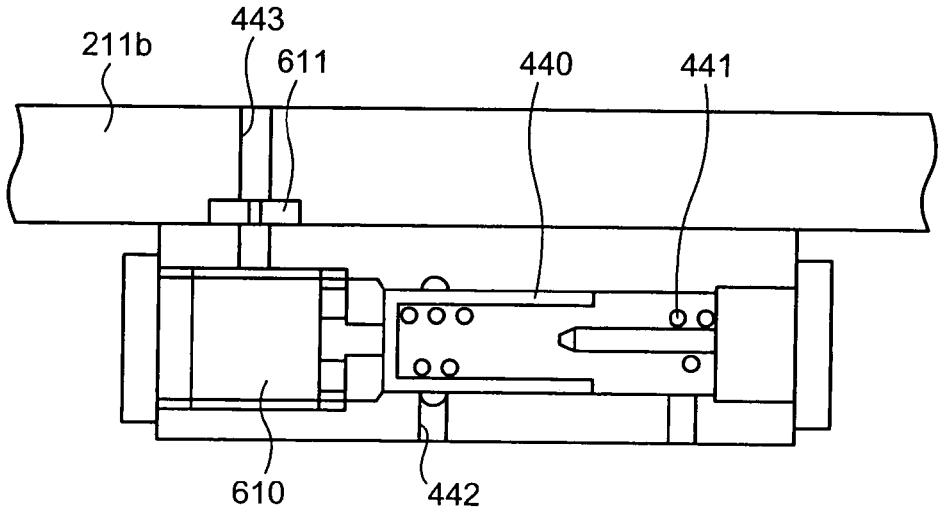
FIG. 25 is a vertical sectional view showing a main portion of a second modification of the piston apparatus according to the third embodiment of the present invention.
Figure 26:
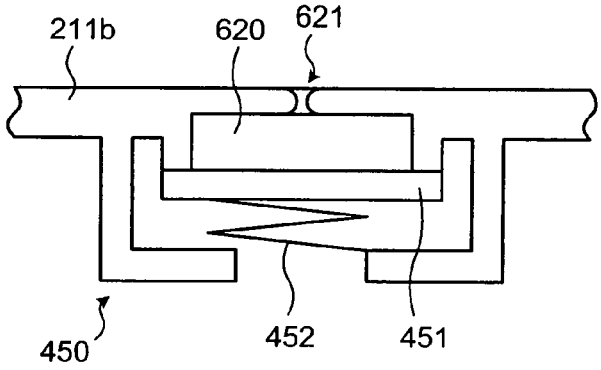
FIG. 26 is a vertical sectional view showing a main portion of another example of the second modification of the piston apparatus according to the third embodiment of the present invention.

Small chambers (buffers) 610 and 620 are arranged between the check valves 440 and 450 and the working space of the high-temperature side cylinder 22 shown in FIGS. 25 and 26, respectively. The small chambers 610 and 620 communicate with the working space via orifices 611 and 621, respectively. In FIG. 25, reference character 441 denotes a spring of the check valve 440, reference character 442 denotes a communication hole leading to the pressure-accumulating chamber, and reference character 443 denotes a hole through which the working fluid is introduced. In FIG. 26, reference characters 451 and 452 denote a valving element and a spring, respectively, of the check valve 450.

Figure 27:
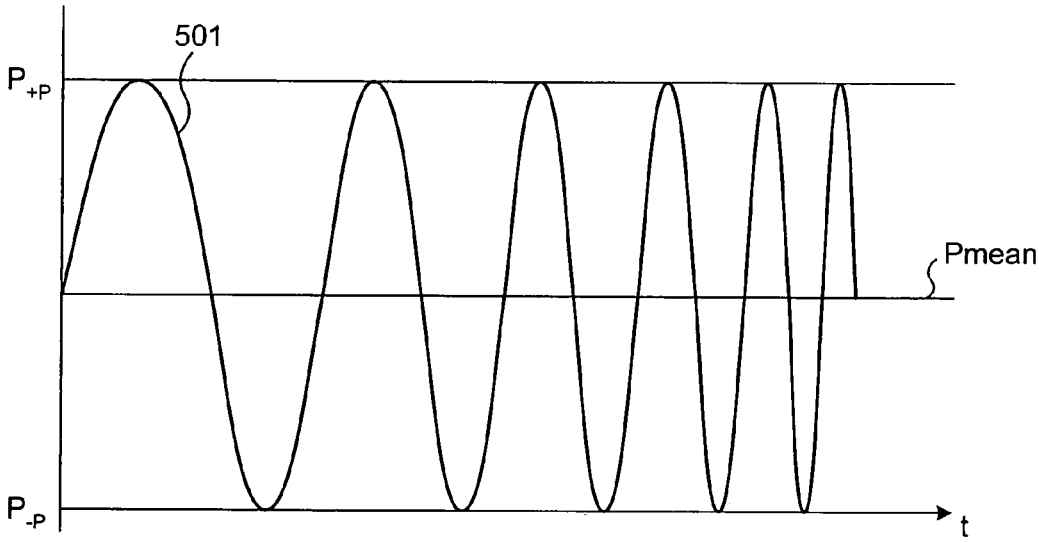
FIG. 27 is a graph of cycles of variations in the pressure of the working space in the second modification of the piston apparatus according to the third embodiment of the present invention.
Figure 28:
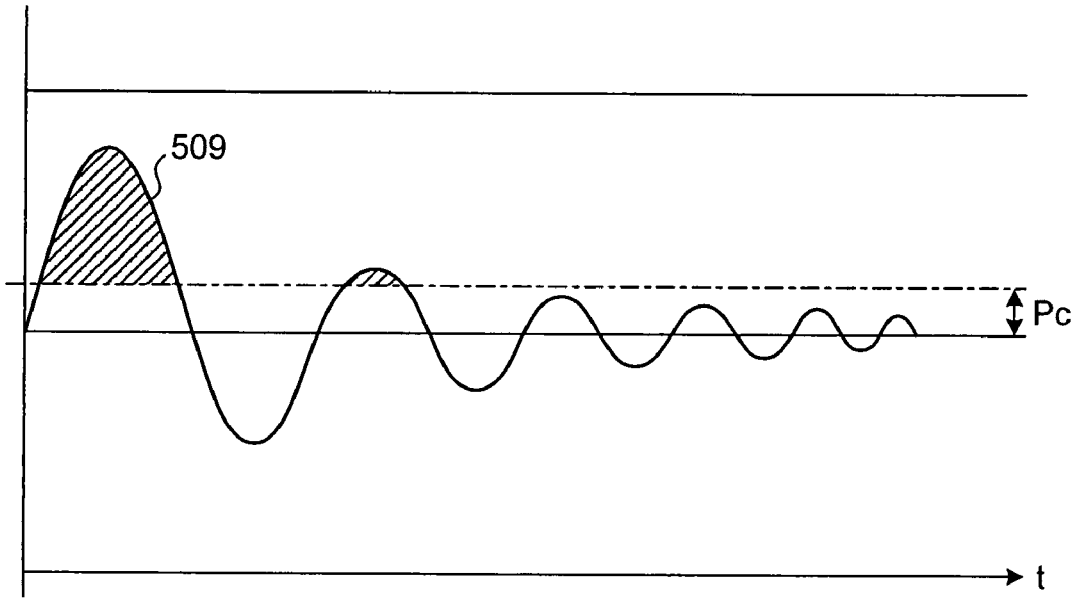
FIG. 28 is a graph showing pressure variations in a small chamber in the second modification of the piston apparatus according to the third embodiment of the present invention.

FIG. 27 indicates that a fluctuation cycle of the pressure 501 within the working space shortens over the time (i.e., along with the increase in the number of rotations of the stirling engine 10). In FIG. 28, reference character 509 denotes the pressure in the small chambers 610 and 620.

As shown in FIG. 27, as the number of rotations increases after the activation, the fluctuation cycle of the pressure within the working space shortens. The amplitude of the pressure in each of the small chambers 610 and 620 decreases corresponding to the pressure fluctuation within the working space, and the peak value at the high-pressure side becomes lower than the set valve-opening pressure value Pc. Thus, the check valves 440 and 450 are fixed in the closed state.

In the second modification, small chambers 610 and 620 communicating with the working space through the orifices 611 and 621, respectively, are provided between the check valves 440 and 450 and the working space. Therefore, the check valves 440 and 450 become difficult to open along with the rise of the number of rotations of the stirling engine 10 (i.e., as the fluctuation cycle of the pressure within the working space becomes shorter). Thus, the check valves 440 and 450 can be designed to have a low valve-opening pressure Pc. Therefore, when the number of rotations of the stirling engine 10 is small (at the early phase of the activation), the check valves 440 and 450 can be made to easily open, whereby the accumulated pressure value of the hollow portion 212 can be raised in cycles of a smaller number.

In the second modification, it is possible to make the check valve operate only at the time of activation and close in the normal operation range even when the condition concerning the set value of valve-opening pressure Pc described in relation to the third embodiment is not satisfied, with the use of the small chambers 610 and 620 communicating with the working space through the orifices 611 and 621 provided between the check valves 440 and 450 and the working space. The second modification can be combined with the third embodiment, or with the first modification of the third embodiment.

Fourth Embodiment

A fourth embodiment will be described.

A stirling engine will be described as an example of a piston engine, hereinbelow. In the following example, exhaust heat of an internal combustion engine mounted on a vehicle, for example, is recovered with the use of the stirling engine. An object from which the exhaust heat is recovered is not limited to the internal combustion engine. The present invention is applicable, for example, to the recovery of exhaust heat from factories, plants, or power generation plants.

A piston engine according to the fourth embodiment introduces a working fluid from a working space in a cylinder to a hollow portion in a piston, and ejects the introduced working fluid to a space between a circumferential portion of the piston and the cylinder. The piston engine includes a pressurized-state maintaining unit which operates in a direction perpendicular to the operational direction of the piston, and introduces the working fluid into the hollow portion from an inlet opening, which opens towards the hollow portion, of an introduction channel, and which also prevents the back-flow of the working fluid from the hollow portion to the cylinder.

Figure 29:
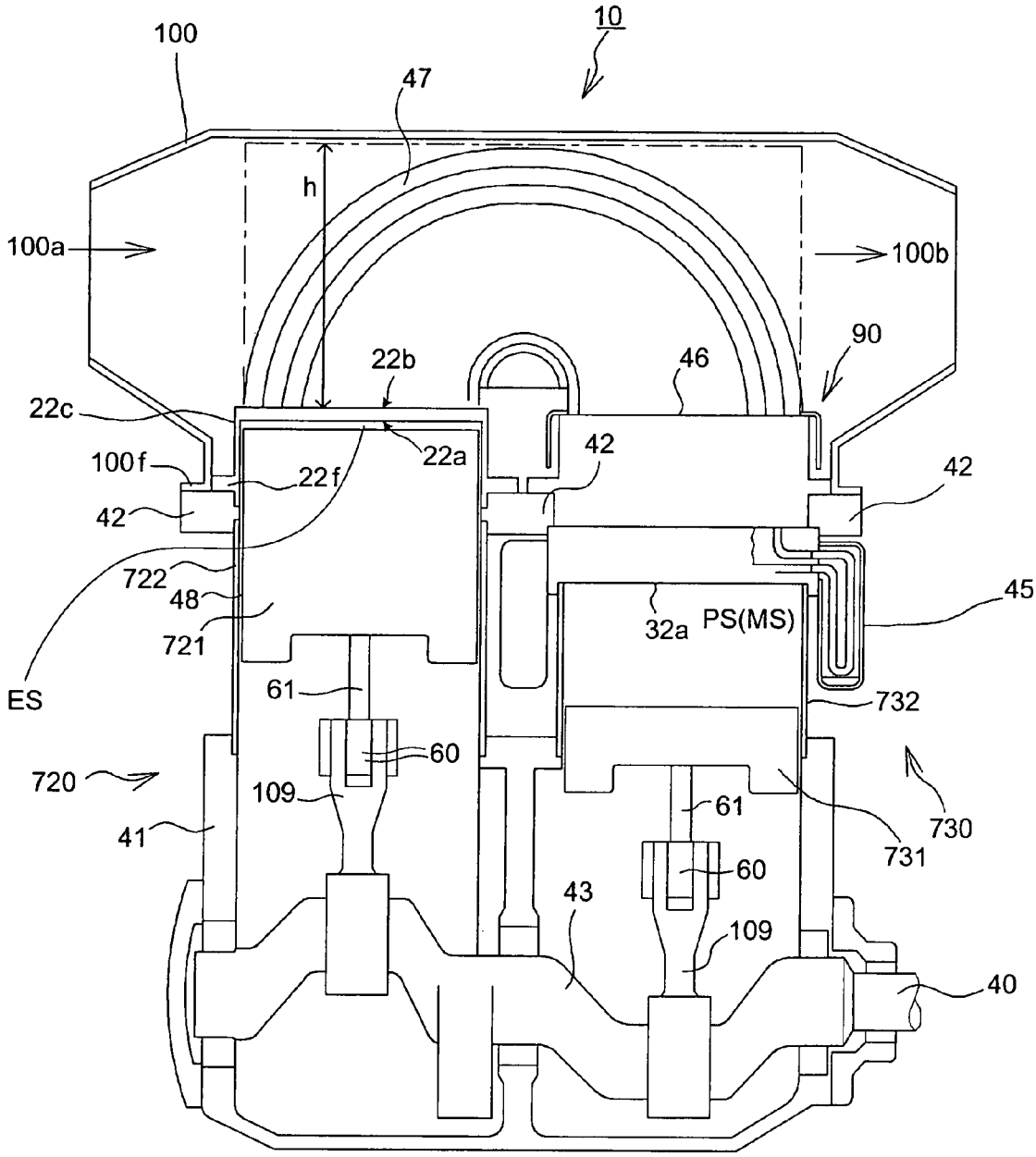
FIG. 29 is a sectional view showing a piston engine in a piston apparatus according to a fourth embodiment of the present invention.
Figure 30:
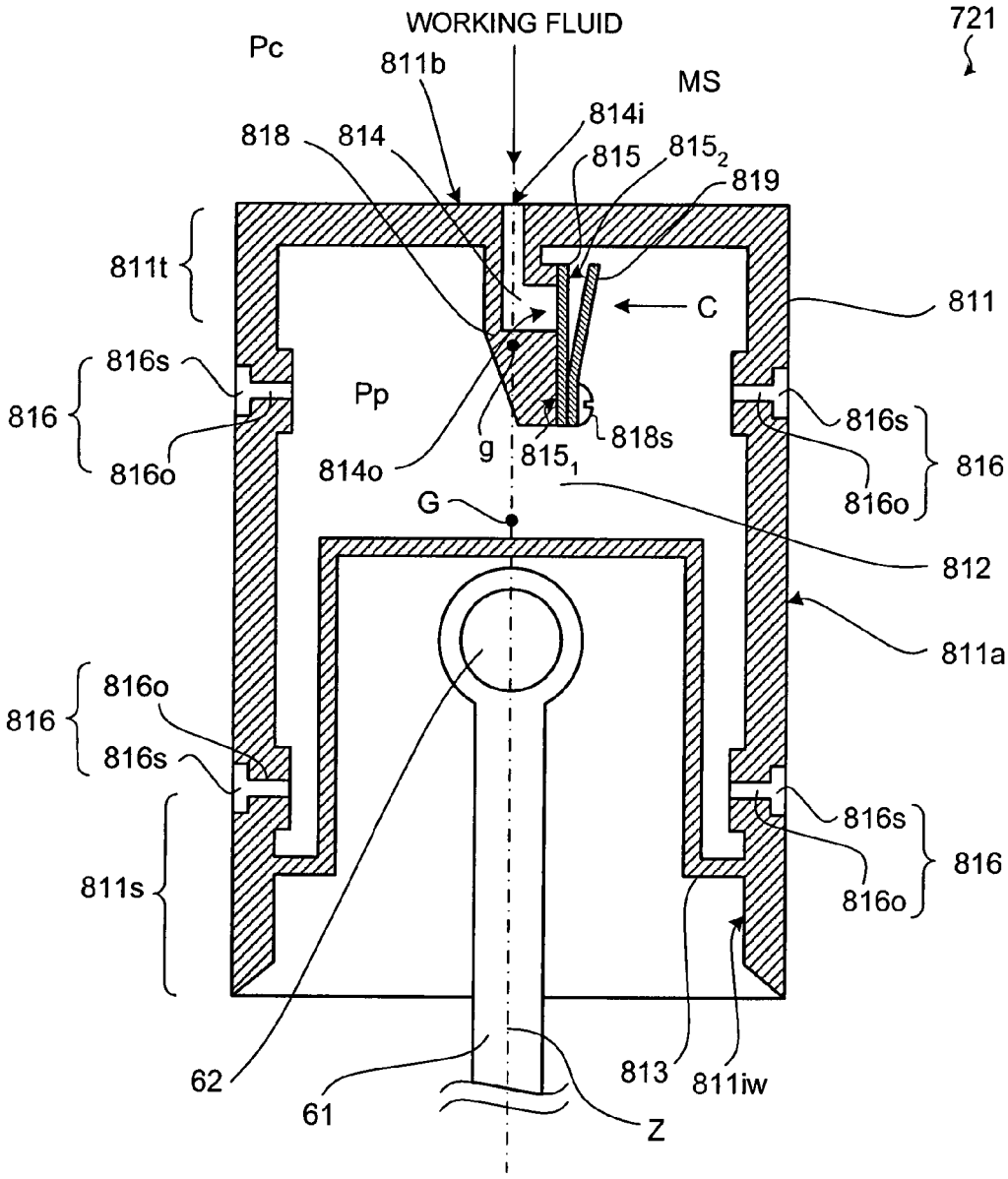
FIG. 30 is a sectional view showing a piston provided in a piston engine of the piston apparatus according to the fourth embodiment of the present invention.
Figure 31:
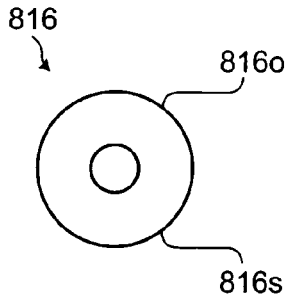
FIG. 31 is a front view showing an air-feed hole provided in the piston engine in the piston apparatus according to the fourth embodiment of the present invention.
Figure 32:
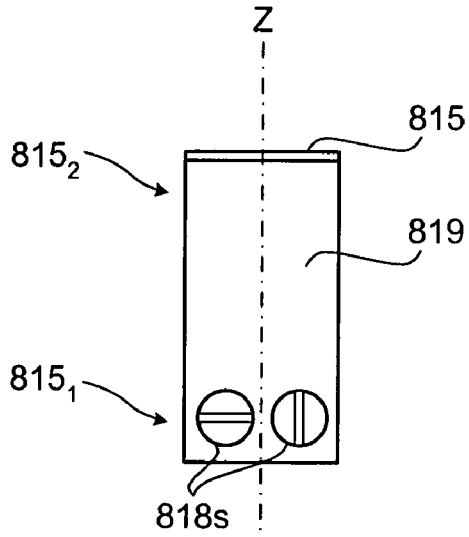
FIG. 32 is a diagram showing a reed valve viewed from a direction of an arrow C of FIG. 30.
Figure 33:
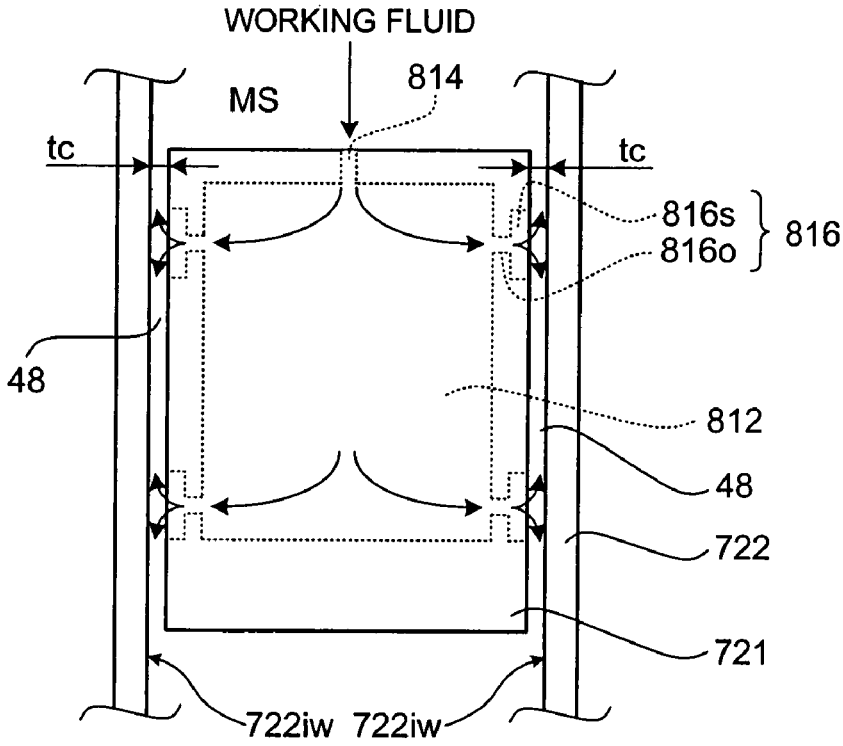
FIG. 33 is a diagram showing the piston engine in operation in the piston apparatus according to the fourth embodiment of the present invention.

FIG. 29 is a sectional view showing the piston engine according to the fourth embodiment. FIG. 30 is a sectional view showing a piston of the piston engine according to the fourth embodiment. FIG. 31 is a front view showing an air-feed hole provided in the piston engine according to the fourth embodiment. FIG. 32 is a view showing the pressurized-state maintaining unit, i.e., a reed valve viewed from a direction shown by an arrow C of FIG. 30. FIG. 33 is a view showing the piston engine in operation according to the fourth embodiment. In these drawings, the components common to those already described will be denoted by the same or corresponding reference characters, and the description thereof will not be repeated.

A piston 721 of a high-pressure side piston/cylinder unit 720 is housed in a cylinder (high-temperature side cylinder) 722, and reciprocates inside the cylinder. A piston 731 of a low-temperature side piston/cylinder unit 730 is housed inside a low-temperature side cylinder 732, and reciprocates inside the cylinder. A working fluid heated by the heater 47 flows into a space (hereinbelow, referred to as expansion space ES for the convenience of description) in the high-temperature side cylinder 722 at the side of the heater 47. A working fluid cooled by the radiator 45 flows into a space (hereinbelow, referred to as compression space PS, for the convenience of description) in the cylinder (low-temperature side cylinder 732) at the side of the regenerative heat exchanger (hereinbelow, referred to simply as regenerator) 46. The expansion space ES and the compression space PS will collectively be referred to as a working space MS.

Configurations of the pistons 721 and 731 will be described in detail below with reference to FIGS. 30 to 33. As shown in FIG. 29, the pistons 721 and 731 are different in size but the same in configuration. Since the pistons 721 and 731 according to the fourth embodiment have the same configuration, only the piston 721 will be described below, and the description will not be repeated for the piston 731.

The piston 721 includes a piston main body 811, a hollow portion (hereinbelow, referred to as pressure-accumulating chamber) 812 formed in the piston main body 811 (i.e., inside the piston 721), and a dividing member 813. In the fourth embodiment, the dividing member 813 is attached to an inner wall 811*iw* of the piston 721 at a hem portion 811s of the piston main body 811. The dividing member 813 is configured so as to avoid the piston pin 62 which serves to attach the piston 721 to the piston-side rod 61 as shown in FIG. 30. According to the configuration described above, the piston main body 811 is closed at the upper portion and the bottom portion with the dividing member 813, and the pressure-accumulating chamber 812 is formed inside the piston main body 811. The hem portion 811*s* is located closer to the side of the crank shaft 43 than the piston 721 (see FIG. 29).

The piston main body 811 includes a circumferential portion (sliding portion) 811*a* which slides against the high-temperature side cylinder 722 (FIG. 29) and a top surface portion 811*b* which is formed like a lid at the side of a piston top portion 811*t* of the piston main body integrally (continuously) with the circumferential portion 811*a*. Further, a valve-forming portion 818 is provided in the top surface portion 811*b* at the side of the pressure-accumulating chamber 812. The valve-forming portion 818 includes an introduction channel 814 inside. The introduction channel 814 communicates the working space MS inside the high-temperature side cylinder 722 with the pressure-accumulating chamber 812. The introduction channel 814 has a working-fluid inlet 814*i* which opens in the top surface portion 811*b*, and a working-fluid outlet 814*o* which opens in the pressure-accumulating chamber 812. The working-fluid outlet 814*o* has a reed valve 815 as a pressurized-state maintaining unit so as to prevent the back-flow of the working fluid introduced into the pressure-accumulating chamber 812.

The reed valve 815 is fixed to the valve-forming portion 818 together with a reed-valve guide 819 via a screw 818*s* which serves as a fixing unit (see FIGS. 30 and 32). The reed valve 815 is fixed to the piston 721 at the bottom side, in other words, at the side of the hem portion 811*s*. The reed valve 815 is a plate-like elastic member and is made of a thin stainless plate (of approximately 0.2 mm to 0.5 mm), for example. It is preferable to make the reed valve 815 as light as possible for the enhancement of responsiveness of the operation. In particular, it is necessary to enhance the responsiveness along with the increase in the number of rotations of the stirling engine 10.

The reed valve 815 is fixed to the valve-forming portion 818 at a fixed portion $815_1$ (FIGS. 30, 32) via the screw 818*s*. Thereby, the reed valve 815 is cantilevered. An operating portion $815_2$ pivots around the fixed portion 815, so as to open/close the working-fluid outlet 814*o* of the introduction channel 814. When the reed valve 815 is configured as a cantilevered element, the length of the reed valve 815 in a direction along a central axis Z of the piston 721 (hereinbelow, referred to as piston-center axis) can be made short, and the reed valve 815 can be made small in length in the direction of the piston-center axis Z (FIGS. 30 and 32). The reed-valve guide 819 prevents an excessive opening of the reed valve and degradation of the durability of the reed valve.

The reed valve 815 limits the flow of the working fluid passing through the introduction channel 814 to the direction from the working space MS to the pressure-accumulating chamber 812. The reed valve 815 opens when the pressure Pc of the working fluid in the working space MS (in-working-space pressure) in the high-temperature side cylinder 722 increases due to the movements of the piston 721 and exceeds the pressure Pp inside the pressure-accumulating chamber 812 (in-pressure-accumulating-chamber pressure), so as to introduce the working fluid in the working space MS of the high-temperature side cylinder 722 to the pressure-accumulating chamber 812. Further, when the in-working-space pressure Pc of the working space MS in the high-temperature side cylinder 722 decreases due to the movements of the piston 721 and becomes lower than the in-pressure-accumulating-chamber pressure Pp, the reed valve 815 is pushed towards the valve-forming portion 818, so as to prevent the back-flow of the working fluid from the hollow portion 812 to the working space MS in the high-temperature side cylinder 722. Thus, the reed valve 815 has a function of maintaining a pressurized-state and a function of introducing the working fluid.

Plural air-feed holes 816 are arranged on a circumferential portion 811*a* of the piston main body 811 at regular intervals in the circumferential direction. As shown in FIGS. 30 and 31, the air-feed hole 816 includes an orifice 816*o* and an enlarged portion 816*s*. As shown in FIG. 33, the working fluid passes through the orifice 816*o* and expands in an enlarged portion 816*s* so as to be ejected to the clearance between the high-temperature side cylinder 722 and the inner wall 722*iw*. Since the enlarged portion 816*s* has a function of accumulating the pressure by retaining the working fluid ejected from the orifice 816*o*, a pressure-receiving surface area of the high-temperature side cylinder 722 can be made larger at the time of activation of the piston 721 so that the piston 721 floats stably supported by a larger force. Further, if the clearance between the piston 721 and the high-temperature side cylinder 722 changes after the reciprocating movements of the piston 721 starts, the amount of flow is adjusted by the orifice 816*o*. Thus, the clearance between the piston 721 and the high-temperature side cylinder 722 can be maintained substantially at the fixed level.

As the piston 721 rises, the working fluid in the working space MS of the high-temperature side cylinder 722 is compressed, and the in-working-space pressure Pc becomes higher than the in-pressure-accumulating-chamber pressure Pp. Then, the reed valve 815 opens. A part of the working fluid in the working space MS is introduced into the pressure-accumulating chamber 812 through the introduction channel 814. When the working fluid is introduced into the pressure-accumulating chamber 812 via the introduction channel 814, a part of the working fluid of the pressure-accumulating chamber 812 is ejected to the clearance between the piston 721 and the high-temperature side cylinder 722 through the air-feed hold 816, thereby forming the air bearing 48. The clearance is approximately 15 micrometers to 30 micrometers in size ts. The reed valve 815 which serves as the pressurized-state maintaining unit and the valve-forming portion 818 to which the reed valve 815 is attached will be described in more detail.

Figure 34:
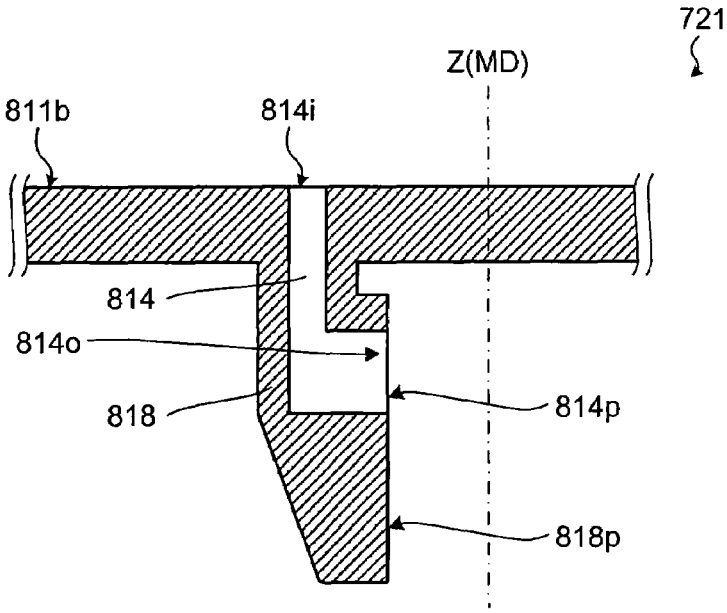
FIG. 34 is a sectional view showing a valve-forming portion in the piston apparatus according to the fourth embodiment of the present invention.
Figure 35:
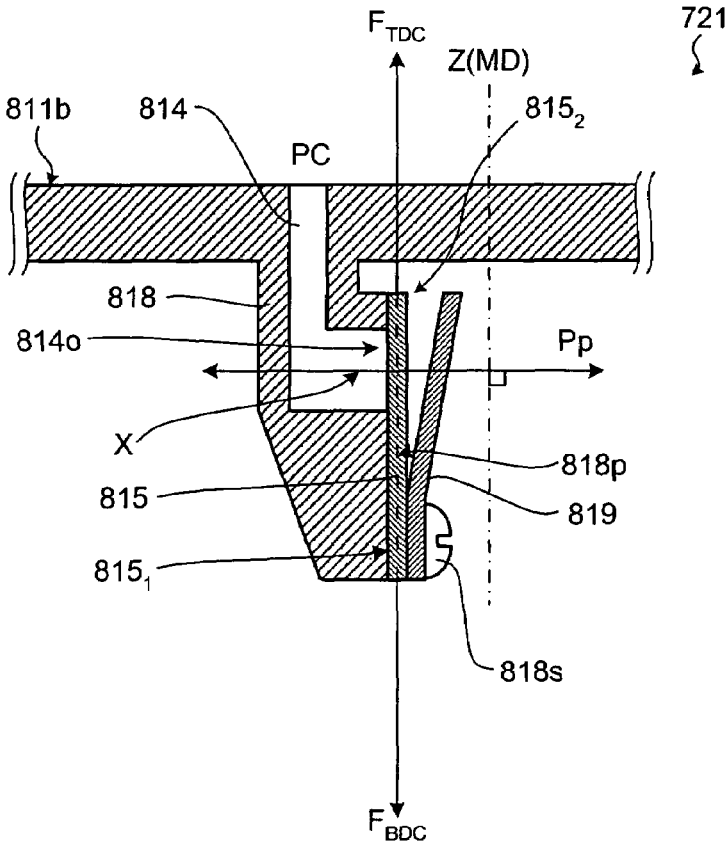
FIG. 35 is a sectional view showing the reed valve attached to the valve-forming portion in the piston apparatus according to the fourth embodiment of the present invention.

FIG. 34 is a sectional view showing the valve-forming portion according to the fourth embodiment. FIG. 35 is a section view showing the reed valve attached to the valve-forming portion according to the fourth embodiment. As shown in FIG. 34, the valve seat of the valve-forming portion 818 to which the reed valve 815 is fixed and the valve attachment portion 818*p* which is in the same plane with the valve seat are formed parallel to the piston-center axis Z. The opening surface 814*p* of the working-fluid outlet 814*o* of the introduction channel 814 is parallel to the valve attachment portion 818*p* and the piston-center axis Z. The piston-center axis Z is parallel to the direction of movements MD of the piston 721 (FIG. 30).

Since the reed valve 815 is a plate-like elastic member as described above, when the reed valve 815 is fixed to the valve-forming portion 818 via the screw 818*s*, the reed valve 815 is brought into contact with the valve attachment portion 818*p* and closes the working-fluid outlet 814*o* of the introduction channel 814 (FIG. 35). Then, the plate surface of the reed valve 815 becomes parallel to the piston-center axis Z, i.e., the direction of movements MD of the piston 721.

When the in-working-space pressure Pc exceeds the in-pressure-accumulating-chamber pressure Pp, and the force acting on the reed valve due to the pressure difference between Pc and Pp exceeds the force pushing the reed valve 815 to the valve attachment portion 818*p*, the reed valve 815 behaves so as to move away from the valve attachment portion 818*p*. Then, the working fluid passes through the introduction channel 814 and flows from the working-fluid outlet 814*o* to the pressure-accumulating chamber 812 (see FIG. 30).

When the in-working-space pressure Pc becomes lower than the in-pressure-accumulating-chamber pressure Pp, and the force acting on the reed valve due to the pressure difference between Pc and Pp becomes lower than the force of the reed valve 815 pushing itself to the valve attachment portion 818*p*, the reed valve 815 behaves so as to move toward the valve attachment portion 818*p*. Then, the working-fluid outlet 814*o* is closed and the flow of the working fluid toward the pressure-accumulating chamber 812 (see FIG. 30) is stopped. When the working-fluid outlet 814*o* opens/closes, the reed valve 815 moves in the direction of arrow X shown in FIG. 35. The direction of movements of the reed valve 815 (direction at the moment the reed valve starts moving) is configured to be perpendicular to the direction of movements MD of the piston 721 (which is parallel to the piston-center axis Z). The reason for this configuration will be described below.

Figure 36A:
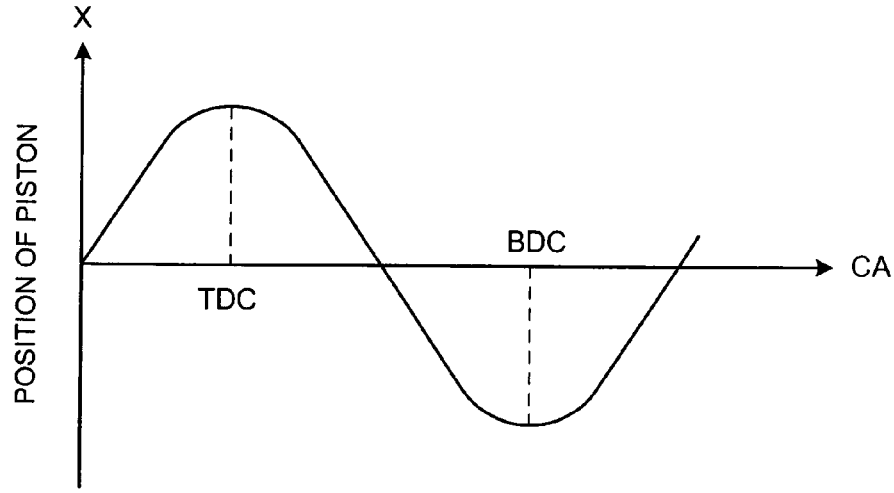
FIG. 36A is a graph of piston position against crank angle.
Figure 36B:
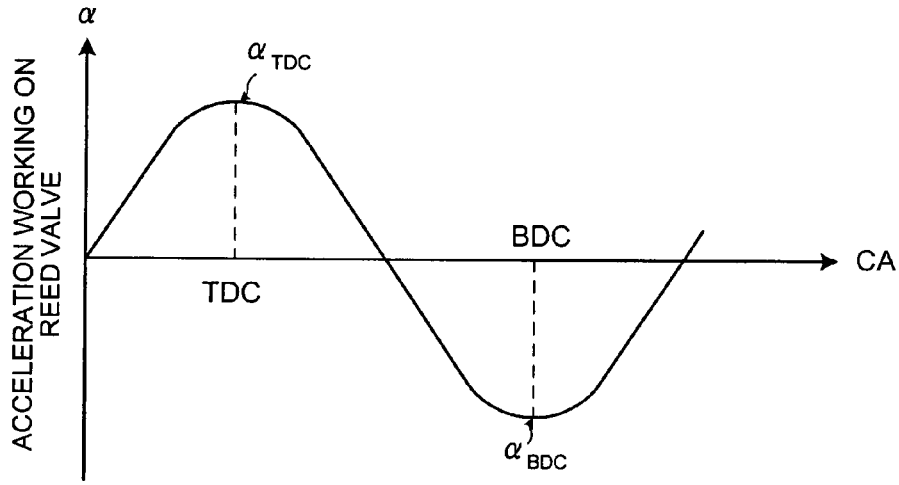
FIG. 36B is a graph of acceleration applied to the reed valve against the crank angle.
Figure 36C:
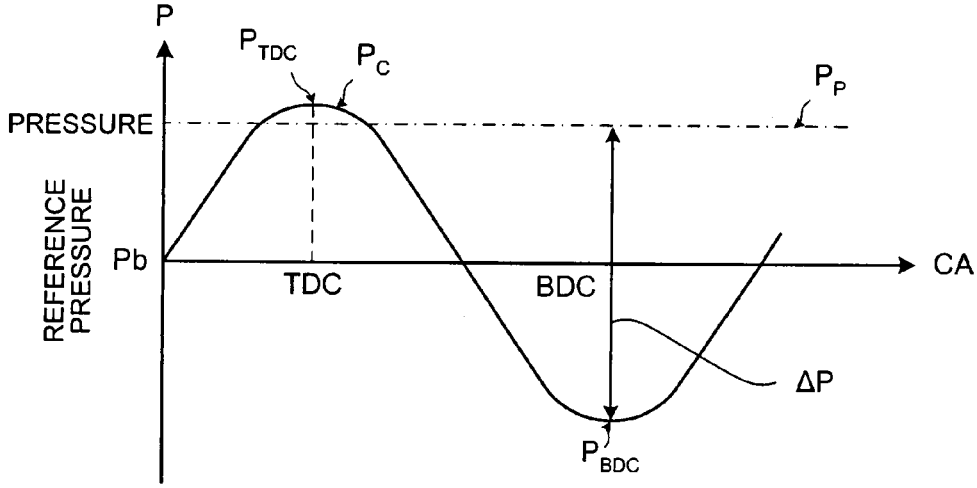
FIG. 36C is a graph of pressure inside the working space against the crank angle.

FIGS. 36A to 36C show relations between the piston position relative to the crank angle, acceleration applied to the reed valve, and the in-working-space pressure, respectively. While the stirling engine 10 is running, an acceleration attributable to the reciprocating movements of the piston 721 is applied to the reed valve 815. The direction the acceleration is applied is parallel to the direction of movements MD of the piston 721 (FIG. 35).

When the piston 721 comes to the position of a TDC (Top Dead Center) or a BDC (Bottom Dead Center) while the stirling engine 10 is running, the absolute value of the acceleration applied to the reed valve 815 reaches its maximum value. The acceleration applied to the reed valve 815 while the piston 721 is at the TDC is represented as $\alpha_{TDC}$, and the acceleration applied to the reed valve 815 while the piston 721 is at the BDC is represented as $\alpha_{BDC}$. As shown in FIG. 35, when the piston 721 is at the TDC or BDC, the force $F_{TDC}$ ($=\alpha_{TDC}\times m$), or $F_{BDC}$ ($=\alpha_{BDC}\times m$) acts on the reed valve 815 in the direction of arrow $F_{TDC}$ or $F_{BDC}$ shown in FIG. 35. Here, m represents the mass of the reed valve 815. The direction the force $F_{TDC}$ and $F_{BDC}$ act on the reed valve 815 at the TDC and the BDC is parallel to the direction of movements of the piston 721, i.e., the direction of the piston-center axis Z.

As shown in FIG. 36C, in the stirling engine 10 according to the fourth embodiment, the in-working-space pressure Pc exceeds the in-pressure-accumulating-chamber pressure Pp in the neighborhood of TDC, and the working fluid is introduced into the pressure-accumulating chamber 812. The reed valve 815 needs to open at the pressure difference between the Pc and Pp of this time. However, since the pressure difference at this time is small, it is necessary to design the reed valve 815 so as to open/close in response to low pressure.

When the technique described in Patent Document 1 is applied, since the direction of movement of the check valve is parallel to the acceleration attributable to the reciprocating movements of the piston 721, if the check valve is set so as not to malfunction at the BDC where the maximum force is applied in the direction to open the check valve, the check valve may not be open at the TDC. Particularly when the engine is running at a high rotational speed, such failure becomes prominent. Therefore, it is difficult to set the check valve using the technique described in Patent Document 1 so as to introduce the gaseous matter into the space inside the piston at the TDC and maintain the introduced gaseous matter until the next introduction. Particularly when the engine is running at a high rotational speed, such setting is substantially impossible. Thus, the technique described in Patent Document 1 can be applied practically only when the engine is running at a low rotational speed.

As already described, in the stirling engine 10 according to the fourth embodiment, the plate surface of the reed valve 815 is parallel to the direction of movements MD of the piston 721 (i.e., parallel to the piston-center axis Z). Therefore, the direction of movements of the reed valve 815 is perpendicular to the direction of movements MD of the piston 721 (i.e., direction parallel to the piston-center axis Z), or perpendicular to the direction of acceleration generated due to the reciprocating movements of the piston 721 at the TDC or the BDC.

As a result, even when the acceleration attributable to the reciprocating movements of the piston 721 is applied to the reed valve 815, the operation of the reed valve 815 is not affected much. In other words, the valve-opening pressure of the reed valve 815 determined according to the elasticity modulus, the thickness, and the like of the reed valve 815 is not practically affected by the acceleration. Hence, the reed valve 815 can be opened/closed irrespective of the acceleration. Even when the stirling engine 10 is running at a high rotational speed, in other words, even under the high acceleration, the reed valve 815 operates securely to introduce the gaseous matter into the space inside the piston at the TDC and maintain the gaseous matter until the next introduction.

The check valve disclosed in Patent Document 1 has a mechanical operating portion which applies pressure to the valving element with the spring. In such a check valve, the valving element and the spring slide with each other at the operation. Therefore, the vibrations caused by the repeating reciprocating movements of the piston causes fretting wear, for example, in the valving element and the spring, and the durability of the check valve might be degraded. In the fourth embodiment, however, the reed valve which operates only according to the elastic deformation is used as the pressurized-state maintaining unit, and hence, the elements do not slide while the reed valve operates. Thus, the fretting wear and the like caused by the vibrations attributable to the reciprocating movements of the piston is significantly reduced. As a result, the durability of the pressurized-state maintaining unit can be significantly enhanced.

Further, in the fourth embodiment, the pressurized-state maintaining unit (i.e., reed valve 815) is used in a gaseous matter which has a low attenuation rate of the vibrations. Therefore, if the movements of operation of the pressurized-state maintaining unit is set parallel to the direction of acceleration attributable to the reciprocating movements of the piston as in the technique disclosed in Patent Document 1, the pressurized-state maintaining unit vibrates sympathetically due to the influence of the vibrations attributable to the change in the acceleration. Then, if the pressurized-state maintaining unit is employed in a gaseous matter having a low attenuation rate of vibrations, the pressurized-state maintaining unit easily vibrates sympathetically, because the vibrations thereof hardly attenuate. On the other hand, since in the fourth embodiment, the direction of operation of the pressurized-state maintaining unit (i.e., reed valve 815) and the direction of movements of the piston 21 are perpendicular with each other, the pressurized-state maintaining unit does not receive the influence of the vibrations caused by change in the acceleration substantially. Thus, the sympathetic vibrations of the pressurized-state maintaining unit (i.e., reed valve 815) are suppressed, and the stable operation can be realized.

In the neighborhood of the TDC, an upward acceleration, i.e., acceleration acting toward the top surface portion 811*b* of the piston 721 is applied to the reed valve 815, and reaches its maximum value at the TDC. As described earlier, the reed valve 815 is fixed to the valve-forming portion 818 at the bottom side of the piston 721, i.e., at the side of the hem portion 811*s* (FIG. 30). Therefore, the reed valve 815 is pulled upward by the acceleration in the neighborhood of the TDC, and would not be bent.

On the other hand, downward acceleration, i.e., acceleration acting towards a direction of the hem portion 811*s* of the piston 721 is applied to the reed valve 815 in the neighborhood of the BDC, and reaches its maximum value at the BDC. As shown in FIG. 36C, the in-working-space pressure Pc is minimum at the BDC. On the other hand, since the in-pressure-accumulating-chamber pressure Pp is approximately constant, the pressure difference ΔP of the in-pressure-accumulating-chamber pressure Pp and the in-working-space pressure Pc reaches its maximum value at the BDC. Since the reed valve 815 is pushed toward the valve attachment portion 818*p* of the valve-forming portion 818 with the pressure ΔP at the BDC, even if the downward force acts on the reed valve 815 in the neighborhood of the BDC, the reed valve 815 can be prevented from being bent. It is preferable that the operation direction of the pressurized-state maintaining unit (i.e., reed valve 815) and the direction of movements of the piston 721 form precisely 90°. However, manufacturing error is tolerable. The crossing angle of the operation direction of the pressurized-state maintaining unit (i.e., reed valve 815) and the direction of movements of the piston 721 may be slightly off from 90° within a range where the influence of the acceleration attributable to the reciprocating movements of the piston 721 can be tolerated.

Figure 37:
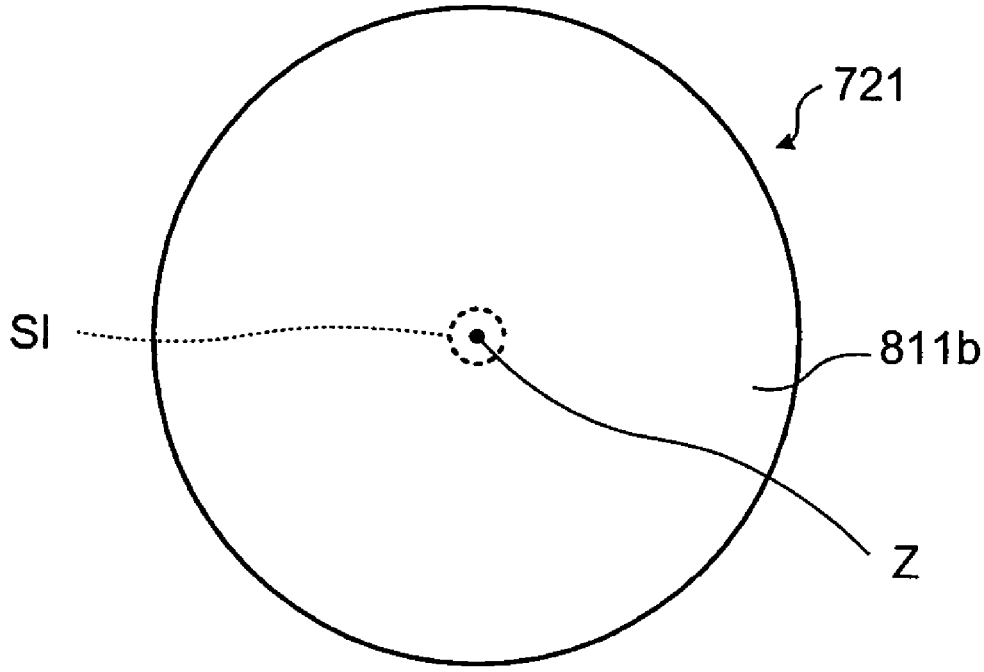
FIG. 37 is a plan view showing a top-surface portion of the piston in the piston apparatus according to the fourth embodiment of the present invention.
Figure 38A:
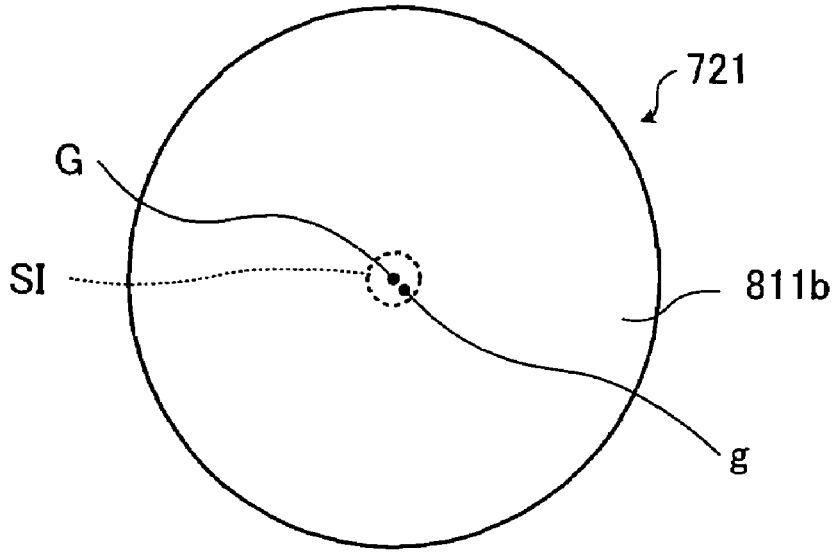
FIG. 38A is a plan view showing the top-surface portion of the piston in the piston apparatus according to the fourth embodiment of the present invention.
Figure 38B:
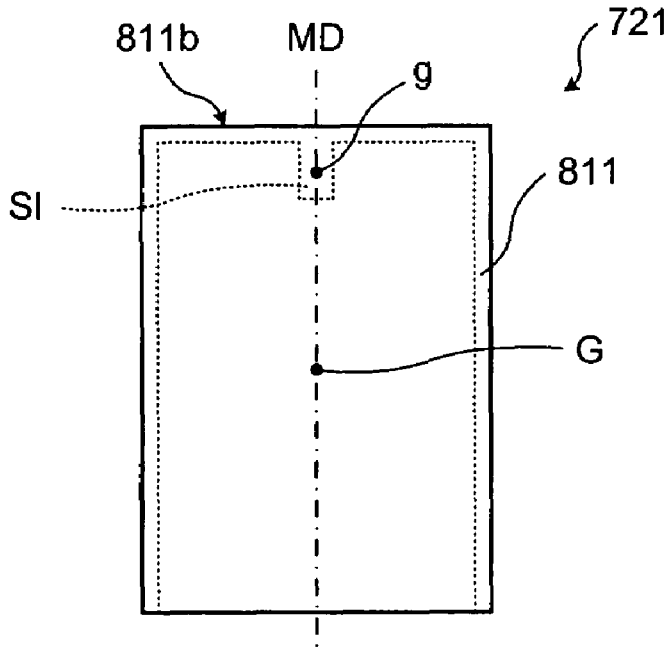
FIG. 38B is a side view showing the piston in the piston apparatus according to the fourth embodiment of the present invention.

FIGS. 37 and 38A are plan views of the top surface portion of the piston according to the fourth embodiment. FIG. 38B is a side view showing the piston according to the fourth embodiment. A structural body SI (FIG. 37) including the valve-forming portion 818, the reed valve 815, and the spring 818*s* is preferably arranged at a central portion of the top surface portion 811*b* of the piston 721. In other words, it is preferable to arrange the structural body SI near the piston-center axis Z.

When the structural body SI is arranged as described above, the distance between the introduction channel 814 formed in the valve-forming portion 818 shown in FIG. 30 and the plural air-feed holes 816 can be made equal. Then, the condition of working fluid (the amount, pressure) ejected from each of the plural air-feed holes 816 when the working fluid of the working space MS is introduced into the pressure-accumulating chamber 812 through the introduction channel 814 tend to be the same. As a result, there is less possibility of deviation in the ejected working fluid into the clearance in the circumferential direction of the piston 721, and the air bearing 48 can be made to work stably.

Further, it is preferable to arrange the structural object SI at the central portion of the piston 721 in terms of its relation with the gravity G of the piston 721. Particularly in the fourth embodiment, the linear approximation of the trajectory of the reciprocating movements of the piston 721 is important since the air bearing 48 is employed. Therefore, it is preferable to match the position of the center of gravity g of the structural object SI with the center of gravity G of the piston 721 as much as possible on a plane perpendicular to the direction of movements of the piston 721 as shown in FIGS. 38A and 38B, when the structural object SI is arranged at the central portion of the top surface portion 811*b* of the piston 721. In FIG. 38A, the center of gravity g of the structural object SI is shown slightly off from an actual position for the convenience.

Modification of Fourth Embodiment

Figure 39A:
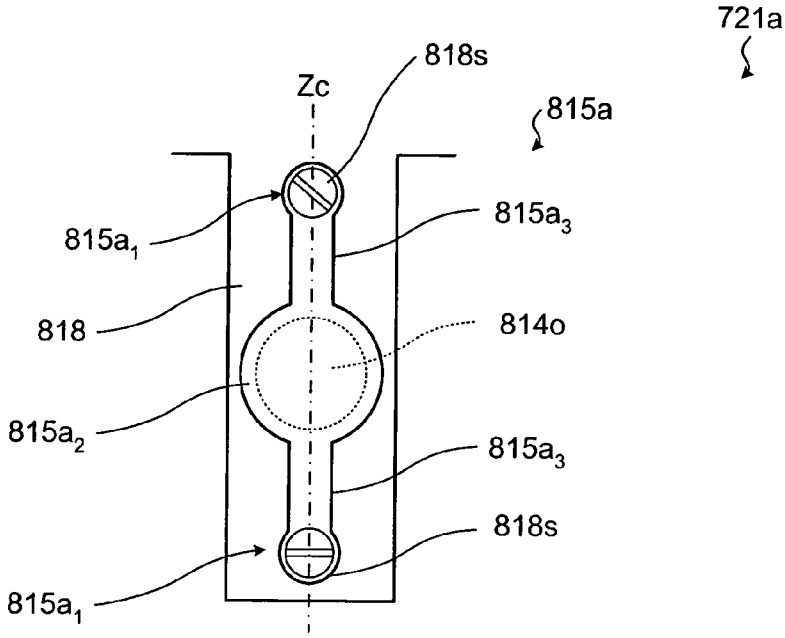
FIG. 39A is a diagram showing a modification of a compressed-state maintaining unit provided in the piston engine in a modification of the piston apparatus according to the fourth embodiment of the present invention.
Figure 39B:
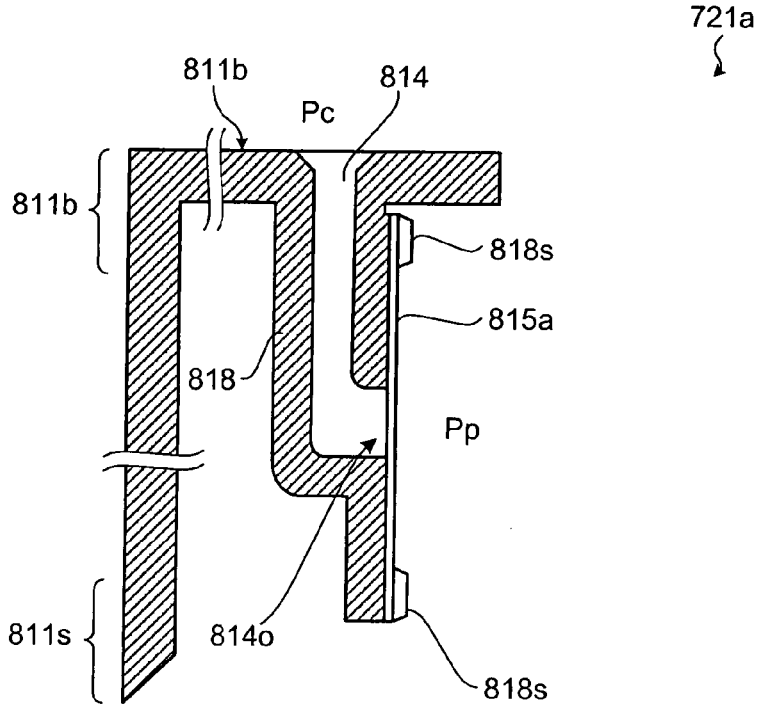
FIG. 39B is a diagram showing a modification of the compressed-state maintaining unit provided in the piston engine in the modification of the piston apparatus according to the fourth embodiment of the present invention.

A modification of the pressurized-state maintaining unit provided in the piston engine according to the fourth embodiment will be described. FIGS. 39A to 41B are diagrams of the modification of the pressurized-state maintaining unit provided in the piston engine according to the fourth embodiment. A reed valve 815*a*, which serves as the pressurized-state maintaining unit and is shown in FIGS. 39A and 39B, is arranged so that fixing portions 815$a_1$, 815$a_1$, and an operating portion 815$a_2$ of the reed valve 815 are arranged on a straight line Zc which is parallel to the central axis of the piston 721*a* shown in FIG. 39A. The reed valve 815*a* is fixed to the valve-forming portion 818 via the screw 818*s* at two positions, i.e., at the side of the top surface portion 811*b* and at the side of the hem portion 811*s* of the piston 721*a*. The fixing portions 815$a_1$, 815$a_1$, and the operating portion 815$a_2$ shown in FIG. 29A are connected via a connecting portion 815$a_3$.

The operating portion 815*a*2 covers the working-fluid outlet 814*o* of the introduction channel 814, and moves away from the valve-forming portion 818 when the pressure difference between the in-working-space pressure Pc and the in-pressure-accumulating-chamber pressure Pp exceeds the valve-opening pressure of the reed valve 815*a*. The reed valve 815*a* is fixed on the straight line Zc which is parallel to the central axis of the piston 721*a*, and fixed to the valve-forming portion 818 at two positions, i.e., at the side of the top surface portion 811*b* and at the side of the hem portion 811*s* of the piston 721*a*. Therefore, even when the piston engine provided with the piston 721*a* operates at an extremely high rotational speed and a large acceleration is applied to the reed valve 815*a*, the deformation of the reed valve 815*a* is suppressed and the reed valve 815*a* operates securely. Further, since the amount of operation of the operating portion 815*a*2 is smaller than that of the reed valve 815 (FIGS. 30 and 35) described in relation to the fourth embodiment, the reed valve guide 819 (FIGS. 30 and 35) can be eliminated. Such features allow the simplification of the configuration and also contribute to the weight lighting.

Figure 40A:
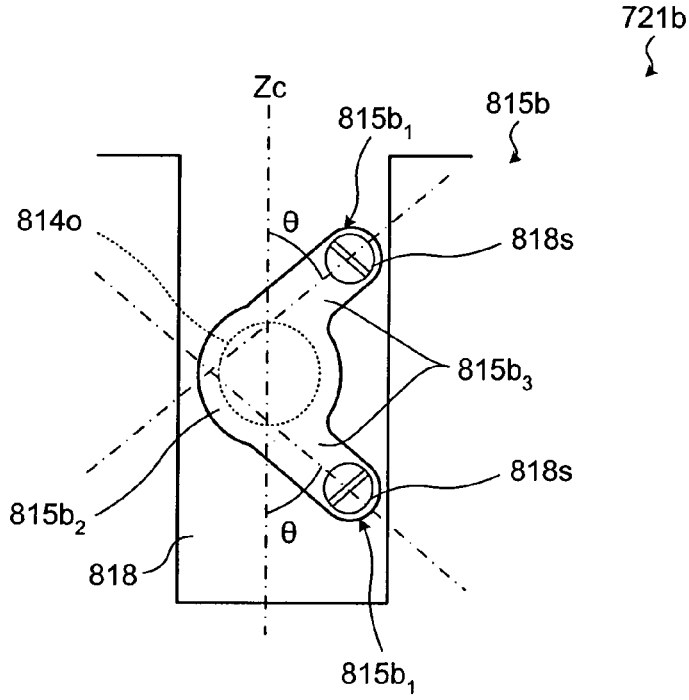
FIG. 40A is a diagram showing a modification of a compressed-state maintaining unit provided in the piston engine in a modification of the piston apparatus according to the fourth embodiment of the present invention.
Figure 40B:
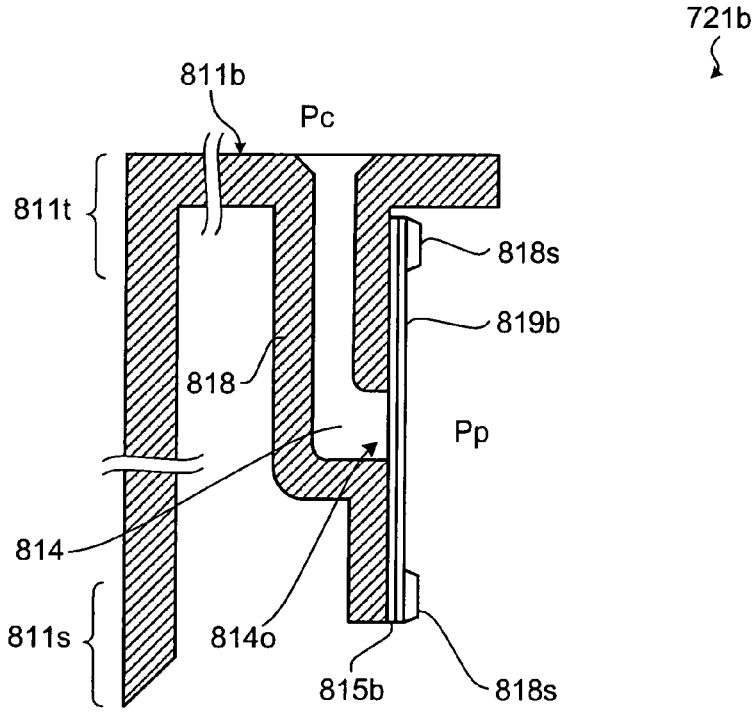
FIG. 40B is a diagram showing a modification of the compressed-state maintaining unit provided in the piston engine in the modification of the piston apparatus according to the fourth embodiment of the present invention.

A reed valve 815*b* which is the pressurized-state maintaining unit shown in FIGS. 40A and 40B is arranged so that fixing portions 815*b*1 and 815*b*1 of the reed valve 815*b* are in the direction perpendicular to the straight line Zc which is parallel to the central axis of the piston 721*b*. The reed valve 815*b* is fixed to the valve-forming portion 818 together with the reed valve guide 819*b* (FIG. 40B) with the screw 818*s* at two positions at the fixing portions 815*b*1 and 815*b*1. The fixing portions 815*b*1 and 815*b*1, and an operating portion 815*b*2 are connected by a coupling portion 815*b*3. The coupling portion 815*b*3 is arranged so as to form an angle q with the straight line Zc.

The operating portion 815$b_2$ covers the working-fluid outlet 814*o* of the introduction channel 814, and moves away from the valve-forming portion 818 when the pressure difference between the in-working-space pressure Pc and the in-pressure-accumulating-chamber pressure Pp exceeds the valve-opening pressure of the reed valve 815*b*. The reed valve 815*b* is fixed to the valve-forming portion 818 at two positions. Therefore, even when the piston engine provided with the piston 721*b* operates at a high rotational speed and a large acceleration is applied to the reed valve 815*b*, the deformation of the reed valve 815*b* is suppressed and the reed valve 815*b* operates securely. The fixing portions 815$b_1$ and 815$b_1$ of the reed valve 815*b* are arranged in a direction perpendicular to the straight line Zc parallel to the central axis of the piston 721*b*. Therefore the dimension of the reed valve 815*b* in the direction of movements of the piston 721*b* can be made small, whereby the dimension of the piston 721*b* in the direction of movements can be made small, accordingly.

Figure 41A:
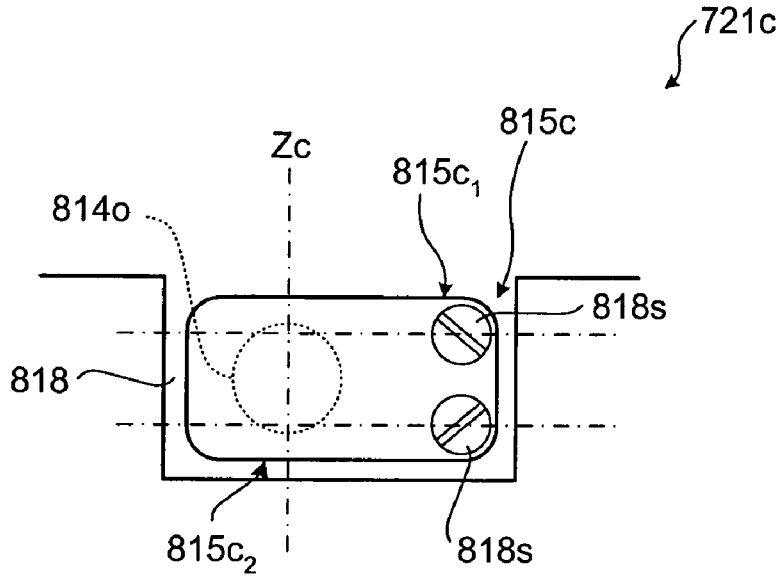
FIG. 41A is a diagram showing a modification of the compressed-state maintaining unit provided in the piston engine in the modification of the piston apparatus according to the fourth embodiment of the present invention.
Figure 41B:
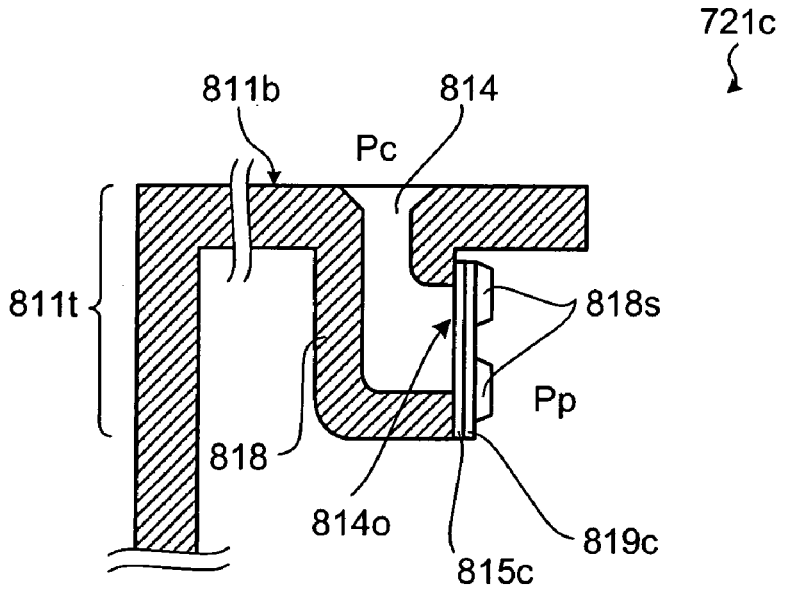
FIG. 41B is a diagram showing the modification of the compressed-state maintaining unit provided in the piston engine in the modification of the piston apparatus according to the fourth embodiment of the present invention.

A reed valve 815*c* which serves as the pressurized-state maintaining unit and is shown in FIGS. 41A and 41B is arranged so that a fixing portion 815$c_1$ of the reed valve 815*c* lies in the direction perpendicular to the straight line Zc which is parallel to the central axis of the piston 721*c*. The reed valve 815*c* is fixed to the valve-forming portion 818 together with a reed valve guide 819*c* (FIG. 41B) with the screw 818*s* at the fixing portion 815$c_1$. The reed valve 815*c* is a plate-like member which appears to be rectangular in a plan view, and whose end opposite to the end fixed to the fixing portion 815$c_1$ makes an operating portion 815$c_2$.

The operating portion 815*c*2 covers the working-fluid outlet 814*o* of the introduction channel 814, and moves away from the valve-forming portion 818 when the pressure difference between the in-working-space pressure Pc and the in-pressure-accumulating-chamber pressure Pp exceeds the valve-opening pressure of the reed valve 815*c*. The reed valve 815*c* is fixed to the valve-forming portion 818 in the direction perpendicular to the straight line Zc which is parallel to the central axis of the piston 721*c*. Therefore, the dimension of the reed valve 815*b* in the direction of movements of the piston 721*c* can be made small, and the dimension of the piston 721*c* in the direction of movements can be made small, accordingly. The configuration of the reed valve 815*c* is effective when the piston engine provided with the piston 721*c* runs at a relatively low rotational speed.

In the piston engine according to the fourth embodiment and the modifications thereof described above, the working fluid is introduced from the working space in the cylinder to the hollow portion in the piston, and the working fluid is ejected to the space between the circumferential portion of the piston and the cylinder, and the piston engine is provided with the pressurized-state maintaining unit which operates in a direction perpendicular to the direction of movements of the piston. Therefore, even when the acceleration attributable to the reciprocating movements of the piston acts on the pressurized-state maintaining unit, the operation of the pressurized-state maintaining unit is not affected substantially. As a result, the pressurized-state maintaining unit can operate irrespective of the acceleration. Thus, even when the piston engine runs at a high rotational speed, i.e., even when the acceleration working on the pressurized-state maintaining unit is large, the pressurized-state maintaining unit operates securely so as to introduce the gaseous matter into the space inside the piston at the TDC and maintain the introduced gaseous matter until the next introduction of the gaseous matter.

In the above example, the stirling engine is configured to be attached to the exhaust pipe so as to use the exhaust gas of the internal combustion engine of the vehicle as a heat source. However, the stirling engine of the present invention is not limited to the type attached to the exhaust pipe of the internal combustion engine of the vehicle. In the above, the configuration, the operation, and the effect of the piston engine, as the stirling engine, are described. The piston engine according to the embodiment, however, is easily applicable to the piston engines other than the stirling engine, and performs the same operation, exerts the same effect, and has the same usefulness.

INDUSTRIAL APPLICABILITY

The piston apparatus according to the present invention is useful for a piston apparatus which does not include a piston ring. The piston apparatus according to the present invention is particularly suitable for a piston apparatus which includes a pressure-accumulating portion inside a piston main body and which ejects a fluid from the pressure-accumulating portion toward an inside of the cylinder.

The invention claimed is:

1. An external combustion engine comprising:

a piston apparatus; and a cylinder, wherein the piston apparatus includes a piston main body, a pressure-accumulating chamber formed inside the piston main body, an introduction portion that is arranged in a first portion corresponding to a predetermined height position in a circumferential portion of the piston main body, and that serves to introduce a working medium compressed in a working space of the external combustion engine into the pressure-accumulating chamber, and a hole that is arranged in a second portion corresponding to a position lower than the predetermined height position in the circumferential portion of the piston main body, and that runs from the pressure-accumulating chamber to a clearance between the piston main body and the cylinder, and a size of the clearance between the first portion in the circumferential portion of the piston main body and the cylinder is configured to be larger when the piston apparatus is at a top dead center than when the piston apparatus is at a bottom dead center.

2. The external combustion engine according to claim 1, wherein a size of a clearance between the second portion in the circumferential portion of the piston main body and the cylinder is configured to be substantially the same when the piston apparatus is at the top dead center and when the piston apparatus is at the bottom dead center, and a size of the clearance between the first portion and the cylinder and a size of the clearance between the second portion and the cylinder in the circumferential portion of the piston main body is configured to be substantially the same when the piston apparatus is at the bottom dead center.

3. The external combustion engine according to claim 1, wherein a diameter of an inner circumferential wall portion of the cylinder to which the first portion of the circumferential portion of the piston main body faces when the piston apparatus is at the top dead center is configured to be larger than a diameter of the inner circumferential wall portion of the cylinder to which the first portion of the circumferential portion of the piston main body faces when the piston apparatus is at the bottom dead center.

4. The external combustion engine according to claim 1, wherein the external combustion engine is an a-type stirling engine, and the size of the clearance between the first portion in the circumferential portion of the piston main body and the cylinder is configured to be larger when the piston apparatus is within a range of ±45° of the top dead center than when the piston apparatus is outside the range.

5. The external combustion engine according to claim 1, wherein, a top surface of the introduction portion is formed in a flat shape so that the entire top surface is of approximately the same height.

6. A fluid device arranged in a piston apparatus which is applied to an external combustion engine and which includes a piston main body and a pressure-accumulating chamber that is formed inside the piston main body, the fluid device serves to introduce a working medium compressed in a working space of the external combustion engine into the pressure-accumulating chamber, wherein the fluid device is arranged so that the working medium can flow in an introduction direction toward the pressure-accumulating chamber and an opposite direction of the introduction direction, and the fluid device has a channel resistance which is larger for the opposite direction than for the introduction direction, a difference between the channel resistance for the introduction direction and the channel resistance for the opposite direction in the fluid device is not based on an channel opening/closing operation of a channel of the fluid device which is caused by an operation of a movable part such as a valving element, but based on a shape of the fluid device, an inlet portion of the fluid device facing against the introduction direction is formed to have a relatively large curvature, and is formed to have an opening whose dimension is gradually decreasing toward inside so that the working medium is drawn into the channel of the fluid device along a smooth streamline, and an inlet portion of the fluid device facing against the opposite direction is formed so that a curvature thereof is zero or nearly zero, and an edge is formed at the inlet portion facing against the opposite direction so as to separate the working medium when the working medium in the pressure-accumulating chamber moves in a direction to flow in the opposite direction.

7. The fluid device according to claim 6, further comprising a protruding portion which protrudes toward the pressure-accumulating chamber is provided at an inlet portion of the fluid device facing against the opposite direction, wherein the inlet portion of the fluid device facing against the opposite direction is arranged at a tip portion of the protruding portion.

8. The fluid device according to claim 6, wherein an angle θ formed by an end surface at the side of the adverse-current inlet portion and the communication channel is a sharp angle.

9. The fluid device according to claim 6, wherein the fluid device is formed integrally with the piston main body.

10. The fluid device according to claim 6, wherein the fluid device is formed separately with the piston main body.

11. The fluid device according to claim 7, wherein the protruding portion is configured with a tube which is separate from the piston main body.

12. The fluid device according to claim 6, wherein an entire portion corresponding to the fluid device is configured with a chip.

13. The fluid device according to claim 6, wherein the fluid device has a two-stage configuration including a small chamber.

14. The fluid device according to claim 13, wherein when the fluid device is configured in two stages with the small chamber arranged therebetween, a communication channel of the fluid device at the side of a hollow portion is relatively small, whereas a communication channel of the fluid device at the side of the working space is relatively large.

15. The fluid device according to claim 14, wherein the two stages of the fluid device are arranged so that the streamlines of the communication channels of the fluid device are offset with each other.

* * * * *